US010529298B1

(12) United States Patent
Fujikawa

(10) Patent No.: US 10,529,298 B1
(45) Date of Patent: Jan. 7, 2020

(54) ELECTRO-OPTICAL DEVICE AND ELECTRONIC DEVICE

(71) Applicant: SEIKO EPSON CORPORATION, Tokyo (JP)

(72) Inventor: Shinsuke Fujikawa, Chino (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 16/565,878

(22) Filed: Sep. 10, 2019

Related U.S. Application Data

(62) Division of application No. 15/821,260, filed on Nov. 22, 2017.

(30) Foreign Application Priority Data

Dec. 1, 2016 (JP) ..... 2016-233918
Oct. 20, 2017 (JP) ..... 2017-203262

(51) Int. Cl.
*G09G 3/36* (2006.01)

(52) U.S. Cl.
CPC ..... *G09G 3/3696* (2013.01); *G09G 3/3614* (2013.01); *G09G 3/3677* (2013.01); *G09G 3/3688* (2013.01); *G09G 2300/0814* (2013.01); *G09G 2310/0251* (2013.01); *G09G 2310/08* (2013.01); *G09G 2320/0209* (2013.01)

(58) Field of Classification Search
CPC .. G09G 3/3696; G09G 3/3688; G09G 3/3614; G09G 3/3677; G09G 2310/0251; G09G 2310/08; G09G 2320/0209; G09G 2300/0814
See application file for complete search history.

(56) References Cited

U.S. PATENT DOCUMENTS

2002/0024486 A1 2/2002 Aoki
2006/0232538 A1 10/2006 Kobashi et al.
2009/0254873 A1 10/2009 Uriu et al.

FOREIGN PATENT DOCUMENTS

JP 3704716 B2 10/2005
WO 9904385 A1 1/1999

*Primary Examiner* — Aneeta Yodichkas
(74) *Attorney, Agent, or Firm* — Oliff PLC

(57) ABSTRACT

An electro-optical device includes a control circuit that controls the timing of output of a precharge voltage to a data line, and changes an elapsed time from start of transition of a voltage of a scanning signal G from a selection voltage to a non-selection voltage until an output of the precharge voltage to the data line according to a polarity of a data voltage, the voltage of the scanning signal for selecting one of multiple scanning lines, the selection voltage causing a pixel transistor to turn on, the non-selection voltage causing a pixel transistor to turn off.

7 Claims, 15 Drawing Sheets

ELECTRO-OPTICAL DEVICE AND ELECTRONIC DEVICE

This application is a divisional application of U.S. patent application Ser. No. 15/821,260, filed on Nov. 22, 2017, which claims priority to each of JP 2016-233918, filed Dec. 1, 2016 and JP 2017-203262, filed Oct. 20, 2017. The disclosures of each of the above references are expressly incorporated by reference herein.

BACKGROUND

1. Technical Field

The present invention relates to an electro-optical device, a method of controlling the electro-optical device, and an electronic device.

2. Related Art

In an electro-optical device that displays an image using a liquid crystal device, a data voltage, which specifies gradation of each pixel, is supplied to the pixel via a data line, and the transmittance of a liquid crystal included in each pixel is controlled to be a transmittance according to the data voltage, thereby causing each pixel to display the specified gradation.

When supply of a data voltage to each pixel is insufficient, for instance, when the time for supplying a data voltage to each pixel cannot be sufficiently ensured, each pixel is unable to accurately display the gradation specified by an image signal, and the display quality may be reduced. In order to cope with the reduction in the display quality due to such insufficient writing of a data voltage to each pixel, the following measures have been made in related art. For instance, International Publication No. WO 99/04385 proposes a technique that facilitates writing of a data voltage to each pixel by outputting a precharge voltage close to the data voltage to each pixel or a data line earlier than the timing of supply of the data voltage.

The precharge voltage is outputted to all the data lines in advance before the output of the data voltage. A period during which the precharge voltage is outputted is called a precharge period, and writing of the data voltage is assisted by writing a predetermined precharge voltage in the precharge period. In addition, this has the effect of reducing vertical crosstalk which is notably recognized when a window pattern is displayed on a halftone gradation background, for instance.

SUMMARY

Along with high resolution of an electro-optical device, the number of transistors connected to one scanning line tends to increase. For this reason, a parasitic capacitance accompanying a scanning line increases, and a drive load of the scanning line increases. Thus, when the resolution of an electro-optical device is enhanced, a response speed of each scanning line is decreased, and the waveform of a scanning signal supplied to the scanning line is rounded. Consequently, when a precharge operation is started for the Nth row (N is a natural number), in the scanning line in the (N−1) the row, selected immediately before the scanning line in the Nth row, selection of a scanning line in the (N−1) the row may not be completed. Thus, an unintended voltage may be written to a pixel corresponding to the scanning line in the (N−1)th row.

An advantage of some aspects of the invention is that even when a driving load of a scanning line increases, unintended writing of a signal to a pixel is reduced by a precharge operation.

An electro-optical device according to an aspect of the invention includes: a plurality of scanning lines; a plurality of data lines; pixels each of which is provided for corresponding one of intersections between the plurality of scanning lines and the plurality of data lines, and includes a pixel transistor that receives a voltage of corresponding one of the plurality of data lines; a scanning line driver that outputs a scanning signal to each of the plurality of scanning lines based on a start pulse and a clock signal; a data line driver that outputs a precharge voltage, then outputs a data voltage having a magnitude according to gradation to be displayed, and reverses a polarity of the data voltage with a predetermined period using a predetermined voltage as a reference; a selector that outputs the precharge voltage and the data voltage which are outputted by the data line driver to a predetermined data line based on a selection signal that specifies start timing of output of the precharge voltage to the data line; and a controller that outputs the start pulse and the clock signal to the scanning line driver, outputs the selection signal to the selector, and changes an elapsed time, according to the polarity of the data voltage, from timing of transition of the clock signal from one of levels to the other of the levels until the start timing specified by the selection signal.

When the number of pixels connected to one scanning line is increased, a parasitic capacitance accompanying the scanning line is increased. For this reason, the waveform of the scanning signal is rounded. Therefore, even when the waveform of the scanning signal supplied to a scanning line is switched from a selection voltage causing a pixel transistor to turn on to a non-selection voltage causing a pixel transistor to turn off, the voltage of the scanning line gradually changes from the selection voltage to the non-selection voltage. Here, when the precharge voltage applied to the data line in transition of the voltage of the scanning line from the selection voltage to the non-selection voltage is lower than the voltage of the scanning line, a pixel transistor corresponding to the scanning line is turned on, and a voltage which is not to be written originally may be written to a pixel. According to an aspect of the invention, the elapsed time from the start of transition of the voltage of a scanning signal from the selection voltage to the non-selection voltage until output of the precharge voltage to the data line is changed according to the polarity of the data voltage, and thus even when the waveform of the scanning signal is rounded due to the effect of a parasitic capacitance, the possibility of turning on a pixel transistor, which is to be turned off originally, can be reduced by applying the precharge voltage to the data line.

An electro-optical device according to an aspect of the invention includes: a plurality of scanning lines; a plurality of data lines; pixels each of which is provided for corresponding one of intersections between the plurality of scanning lines and the plurality of data lines, and includes a pixel transistor that receives a voltage of corresponding one of the plurality of data lines; a scanning line driver that outputs a scanning signal to each of the plurality of scanning lines based on a start pulse and a clock signal; a data line driver that outputs a precharge voltage, then outputs a data voltage having a magnitude according to gradation to be displayed, and reverses a polarity of the data voltage with a predetermined period using a predetermined voltage as a reference; a selector that outputs the precharge voltage and the data voltage which are outputted by the data line driver to a predetermined data line based on a selection signal that specifies start timing of output of the precharge voltage to the data line; and a controller that outputs the start pulse and the clock signal to the scanning line driver, outputs the selection signal to the selector, and changes an elapsed time, according to the polarity of the data voltage, from timing of transition of the clock signal from one of levels to the other of the levels until the start timing specified by the selection signal.

According to this aspect, the elapsed time from the timing of transition of the clock signal from one level to the other level until the start timing specified by the selection signal is changed according to the polarity of the data voltage, and thus even when the waveform of the scanning signal is rounded due to the effect of a parasitic capacitance, the possibility of turning on a pixel transistor, which is to be turned off originally, can be reduced by applying the precharge voltage to the data line.

An electro-optical device according to an aspect of the invention includes: a plurality of scanning lines; a plurality of data lines; pixels each of which is provided for corresponding one of intersections between the plurality of scanning lines and the plurality of data lines, and includes a pixel transistor that receives a voltage of corresponding one of the plurality of data lines; a scanning line driver that outputs a scanning signal to each of the plurality of scanning lines based on a start pulse, a clock signal, and an output control signal; a data line driver that outputs a precharge voltage, then outputs a data voltage having a magnitude according to gradation to be displayed, and reverses a polarity of the data voltage with a predetermined period using a predetermined voltage as a reference; a selector that outputs the precharge voltage and the data voltage which are outputted by the data line driver to a predetermined data line based on a selection signal that specifies start timing of output of the precharge voltage to the data line; and a controller that outputs the start pulse, the clock signal, and the output control signal to the scanning line driver, outputs the selection signal to the selector, and changes an elapsed time, according to the polarity of the data voltage, from timing of transition of the output control signal from one of levels to the other of the levels until the start timing specified by the selection signal.

According to this aspect, the elapsed time from the timing of transition of the output control signal from one level to the other level until the start timing specified by the selection signal is changed according to the polarity of the data voltage, and thus even when the waveform of the scanning signal is rounded due to the effect of a parasitic capacitance, the possibility of turning on a pixel transistor, which is to be turned off originally, can be reduced by applying the precharge voltage to the data line.

In the above-described electro-optical device according to an aspect of the invention, it is preferable that the output control signal become active in a period in which the scanning signal outputted to one of the plurality of scanning lines becomes active, and the timing of transition of the output control signal from the one of the levels to the other of the levels be timing of transition of the output control signal from active to inactive. In this case, the possibility of turning on a pixel transistor, which is to be turned off originally, can be reduced by adjusting the period during which the output control signal becomes inactive according to the polarity of the data voltage.

In the above-described electro-optical device according to an aspect of the invention, it is preferable that the precharge voltage when the data voltage has a positive polarity be higher than the precharge voltage when the data voltage has a negative polarity. When the data voltage has the positive polarity, a data voltage higher than a predetermined voltage is applied to the data line. On the other hand, when the data voltage has the negative polarity, a data voltage lower than a predetermined voltage is applied to the data line. Consequently, writing of the data voltage to each pixel is facilitated by changing the precharge voltage according to the polarity of the data voltage.

In the above-described electro-optical device according to an aspect of the invention, it is preferable that the controller make the elapsed time when the data voltage has a negative polarity longer than the elapsed time when the data voltage has a positive polarity. Even when the precharge voltage is applied to the data line, in order to maintain OFF of the pixel transistor, the voltage of the scanning line needs to be lower than the precharge voltage. Here, the precharge voltage when the data voltage has the negative polarity is lower than the precharge voltage when the data voltage has the positive polarity. According to an aspect of the invention, when the data voltage has the negative polarity, the elapsed time is set longer than the elapsed time when the data voltage has the positive polarity. Thus when the data voltage has the negative polarity, the voltage of the scanning line is made close to the non-selection voltage, and thereby the timing of application of the precharge voltage is delayed until OFF of the pixel transistor can be maintained.

In the above-described electro-optical device according to an aspect of the invention, it is preferable that the pixels each include a retention capacitor in which one of terminals is connected to the pixel transistor, and the other of the terminals is connected to a capacitive line, and a period in which the precharge voltage is outputted to the data line when the data voltage has a negative polarity be made shorter than a period in which the precharge voltage is outputted to the data line when the data voltage has a positive polarity.

As a consequence of the precharge operation, the voltage of the capacitive line is changed due to the coupling capacitance with the data line. Although the voltage of the capacitive line is converged to a certain voltage, from a viewpoint of accurate gradation display, it is preferable to write the data voltage after the voltage of the capacitive line is converged to a certain voltage. The potential variation of the capacitive line caused by the coupling capacitance with the data line is lower in the case where the precharge voltage is written with a data voltage with the negative polarity written than in the case where the precharge voltage is written with a data voltage with the positive polarity written. According to an aspect of the invention, the period in which a precharge voltage corresponding to the data voltage with the negative polarity is outputted to the data line is shorter than the period in which a precharge voltage corresponding to the data voltage with the positive polarity is outputted to the data line, and thus it is possible to set a longer write period for writing the data voltage while ensuring the period until the voltage of the capacitive line is converged.

In the above-described electro-optical device according to an aspect of the invention, it is preferable that timing of start of output of the precharge voltage by the data line driver be earlier than the start timing specified by the selection signal. According to the aspect, even when the precharge voltage is outputted from the data line driver, the selector limits a period in which the precharge voltage is outputted to the data lines.

In the above-described electro-optical device according to an aspect of the invention, a period in which the data line driver outputs the precharge voltage may be approximately equal to a period in which the selection signal becomes active in order to output the precharge voltage to the predetermined data line. According to the aspect, a period in which the data line driver outputs the precharge voltage is made approximately equal to a period in which the selection signal becomes active, thus the power consumption of the data line driver can be reduced.

Next, an electronic device according to an aspect of the invention includes the above-described electro-optical device. Such an electronic device corresponds to a liquid crystal display, and a projector.

Next, a method of controlling an electro-optical device according to an aspect of the invention includes: a plurality of scanning lines; a plurality of data lines; and pixels each of which is provided for corresponding one of intersections between the plurality of scanning lines and the plurality of data lines, and includes a pixel transistor that receives a voltage of corresponding one of the plurality of data lines, the method including: outputting a precharge voltage to the data line, then outputting a data voltage having a magnitude according to gradation to be displayed to the data line; reversing a polarity of the data voltage with a predetermined period using a predetermined voltage as a reference; and controlling timing of output of the precharge voltage to the data line, and changing an elapsed time, according to the polarity of the data voltage, from start of transition of a voltage of a scanning signal from a selection voltage to a non-selection voltage until an output of the precharge voltage to the data line, the scanning signal for selecting one of the plurality of scanning lines, the selection voltage causing the pixel transistor to turn on, the non-selection voltage causing the pixel transistor to turn off.

In addition, a method of controlling an electro-optical device according to an aspect of the invention includes: a plurality of scanning lines; a plurality of data lines; and pixels each of which is provided for corresponding one of intersections between the plurality of scanning lines and the plurality of data lines, and includes a pixel transistor that receives a voltage of corresponding one of the plurality of data lines, the method including: outputting a precharge voltage to the data line, then outputting a data voltage having a magnitude according to gradation to be displayed to the data line; reversing a polarity of the data voltage with a predetermined period using a predetermined voltage as a reference; generating a scanning signal that controls the pixel transistor to be on or off based on a start pulse and a clock signal, and outputting the scanning signal to the plurality of scanning lines; and changing an elapsed time from timing of transition of the clock signal from one of levels to the other of the levels until an output of the precharge voltage to the data line.

In addition, a method of controlling an electro-optical device according to an aspect of the invention includes: a plurality of scanning lines; a plurality of data lines; and pixels each of which is provided for corresponding one of intersections between the plurality of scanning lines and the plurality of data lines, and includes a pixel transistor that receives a voltage of corresponding one of the plurality of data lines, the method including: outputting a precharge voltage to the data line, then outputting a data voltage having a magnitude according to gradation to be displayed to the data line; reversing a polarity of the data voltage with a predetermined period using a predetermined voltage as a reference; generating a scanning signal that controls the pixel transistor to be on or off based on a start pulse, a clock signal, and an output control signal, and outputting the scanning signal to the plurality of scanning lines; and changing an elapsed time from timing of transition of the output control signal from one of levels to the other of the levels until an output of the precharge voltage to the data line.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Figure 1:
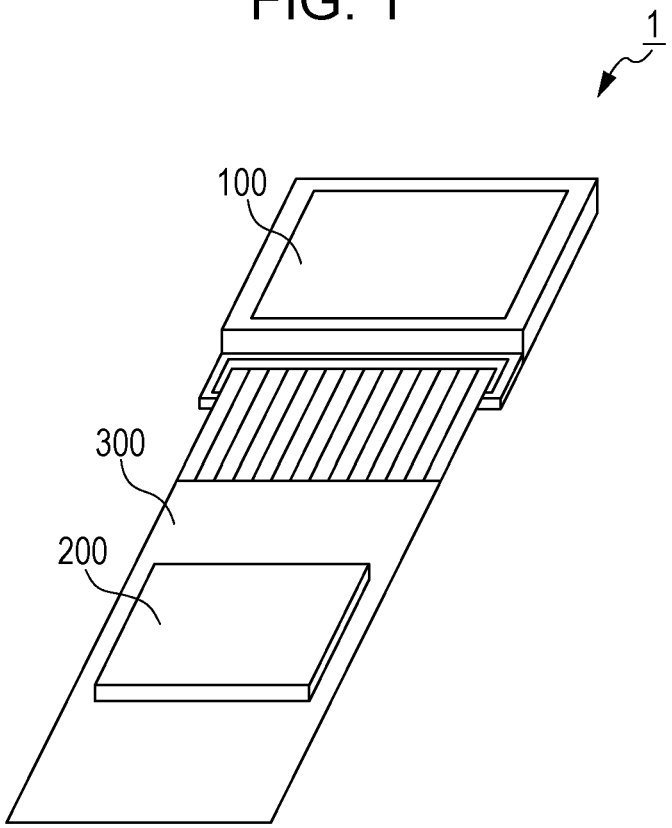
FIG. 1 is an explanatory diagram of an electro-optical device according to an embodiment of the present invention.

A first embodiment of the present invention will be described with reference to FIGS. 1 to 10. FIG. 1 is a diagram illustrating the configuration of a signal transmission system for an electro-optical device 1. As illustrated in FIG. 1, the electro-optical device 1 includes an electro-optical panel 100, a drive integrated circuit (driver IC) 200, and a flexible circuit substrate 300. The electro-optical panel 100 is connected to the flexible circuit substrate 300 on which the drive integrated circuit 200 is mounted. The electro-optical panel 100 is connected to a host CPU device (not illustrated) via the flexible circuit substrate 300 and the drive integrated circuit 200. The drive integrated circuit 200 is a device that receives image signals and various control signals for driving control from the host CPU device via the flexible circuit substrate 300, and drives the electro-optical panel 100 via the flexible circuit substrate 300.

Figure 2:
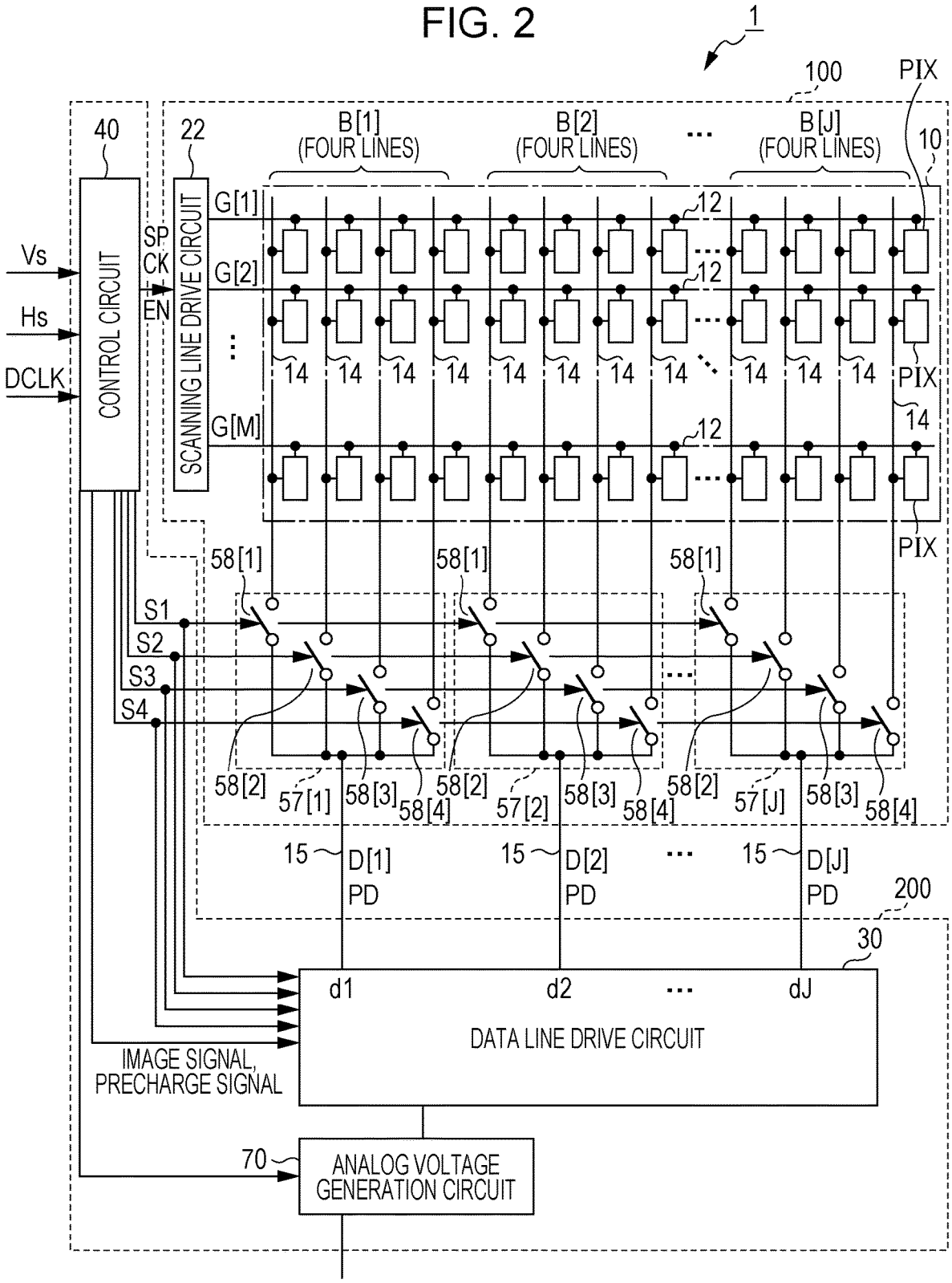
FIG. 2 is a block diagram illustrating the configuration of the electro-optical device according to the embodiment.

FIG. 2 is a block diagram illustrating the configuration of the electro-optical panel 100 and the drive integrated circuit 200. As illustrated in FIG. 2, the electro-optical panel 100 includes a pixel section 10, a scanning line drive circuit 22 serving as a scanning line driver, and J demultiplexers 57[1] to 57[J] serving as a selector (J is a natural number). The drive integrated circuit 200 includes a data line drive circuit 30 serving as a data line driver, a control circuit 40 serving as a controller, and an analog voltage generation circuit 70.

In the pixel section 10, M scanning lines 12 and N data lines 14 crossing each other are formed (M and N are natural numbers). Multiple pixel circuits (pixels) PIX are each provided at a corresponding one of the intersections between the scanning lines 12 and each data line 14, and are arranged in a matrix form of vertical M rows×horizontal N columns.

Figure 3:
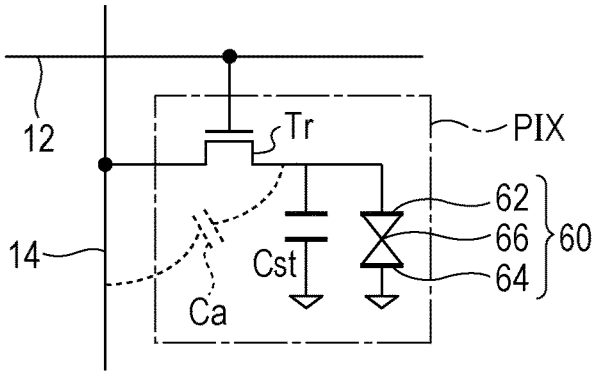
FIG. 3 is a circuit diagram illustrating the configuration of a pixel.

FIG. 3 is a circuit diagram of each of the pixel circuits PIX. As illustrated in FIG. 3, each pixel circuit PIX includes a pixel transistor Tr that includes a liquid crystal device 60, a retention capacitor Cst, and a thin film transistor (TFT). The liquid crystal device 60 is an electro-optical device including a pixel electrode 62 and a common electrode 64 that face each other, and a liquid crystal 66 between both electrodes. The transmittance (display gradation) of the liquid crystal 66 is changed according to a voltage applied across the pixel electrode 62 and the common electrode 64.

The retention capacitor Cst is provided in parallel to the liquid crystal device 60. One terminal of the retention capacitor Cst is connected to the pixel transistor Tr, and the other terminal is connected to the common electrode 64 via a capacitive line which is not illustrated. The pixel transistor Tr is, for instance, an N-channel transistor with a gate connected to the scanning line 12, and is provided between the liquid crystal device 60 and the data line 14 to control electrical connection (conduction/non-conduction) of the liquid crystal device 60 and the data line 14. Setting a scanning signal G[m] to a selection potential causes the pixel transistors Tr of the pixel circuits PIX in the mth row to transition to an ON state simultaneously (m is a natural number from 1 to M).

When a scanning line 12 corresponding to a pixel circuit PIX is selected and the pixel transistor Tr of the pixel circuit PIX is controlled to be an ON state, a voltage according to a data signal D[n] is applied to the liquid crystal device 60, the data signal D[n] being supplied from the data line 14 to the pixel circuit PIX (n is a natural number from 1 to J). Consequently, a transmittance according to the data signal D[n] is set to the liquid crystal 66 of the pixel circuit PIX. Also, when a light source (not illustrated) becomes an ON (lighting) state and light is emitted from the light source, the light passes through the liquid crystal 66 of the liquid crystal device 60 included in the pixel circuit PIX, and travels to an observer. In other words, when a voltage according to the data signal D[n] is applied to the liquid crystal device 60 and the light source becomes an ON state, a pixel corresponding to the pixel circuit PIX displays gradation according to the data signal D[n].

When the pixel transistor Tr becomes an OFF state after a voltage according to the data signal D[n] is applied to the liquid crystal device 60 of the pixel circuit PIX, a data voltage corresponding to the data signal D[n] is held ideally. Therefore, each pixel ideally displays gradation according to the data signal D[n] in a period from after the start of an ON state of the pixel transistor Tr until the next ON state.

As illustrated in FIG. 3, a parasitic capacitance Ca occurs between the data line 14 and the pixel electrode (or between the data line 14 and a wire that electrically connects the pixel electrode 62 and the pixel transistor Tr). Therefore, while the pixel transistor Tr is in an OFF state, a potential fluctuation of the data line 14 may propagate to the pixel electrode 62 via the capacitance Ca to cause a variation in the data voltage of the liquid crystal device 60.

Also, a common voltage LCCOM which is a constant voltage is supplied to the common electrode 64 via a common line which is not illustrated. A voltage, which is approximately −0.5V with respect to the central voltage of the amplitude of the data signal D[n], is used as the common voltage LCCOM. This is due to characteristics of the pixel transistor Tr, a parasitic capacitance between the scanning line 12 and the pixel electrode 62, and a switch 58 included in each demultiplexer 57. It is to be noted that in this embodiment, a push down voltage is assumed to be zero for the sake of simplicity of description.

In this embodiment, in order to prevent what is called burn-in, polarity reversal driving is adopted, in which the polarity of a voltage applied to the liquid crystal device 60 is reversed every vertical scanning period (1V). In this example, the level of the data signal D[n] supplied to the pixel circuit PIX via the data line 14 is reversed every vertical scanning period (1V) with respect to the central voltage of the data signal D[n]. However, the period of polarity reversal may be set to any period, and for instance, may be a multiple of one vertical scanning period V. In this embodiment, the positive polarity refers to the case where the voltage of the data signal D[n] is higher than the central voltage (predetermined voltage), and the negative polarity refers to the case where the voltage of the data signal D[n] is lower than the central voltage (predetermined voltage).

Description is returned to FIG. 2. From an external host CPU device which is not illustrated, the control circuit 40 receives input of external signals such as, a vertical synchronizing signal Vs that defines the vertical scanning period V, a horizontal synchronizing signal Hs that defines a horizontal scanning period H, and a dot clock signal DCLK. The control circuit 40 performs synchronous control of the scanning line drive circuit 22 and the data line drive circuit 30 based on these signals. Under the synchronous control, the scanning line drive circuit 22 and the data line drive circuit 30 cooperate with each other to perform display control of the pixel section 10. In addition, the control circuit 40 outputs a start pulse SP, a clock signal CK, and an output control signal EN to the scanning line drive circuit 22. One period of the clock signal CK in this example is the horizontal scanning period H. When active (high-level in this example), the output control signal EN permits the scanning signals G[1] to G[M] to be active. When inactive (low-level in this example), the output control signal EN prohibits the scanning signals G[1] to G[M] from being active. The output control signal EN becomes active when one of the scanning signals G[1] to G[M] outputted to respective multiple scanning lines 12 becomes active.

Normally, display data forming one display screen is processed frame by frame, and the processing period is one frame period (1F). When one display screen is formed by a single vertical scan, the frame period F corresponds to the vertical scanning period V.

Figure 4A:
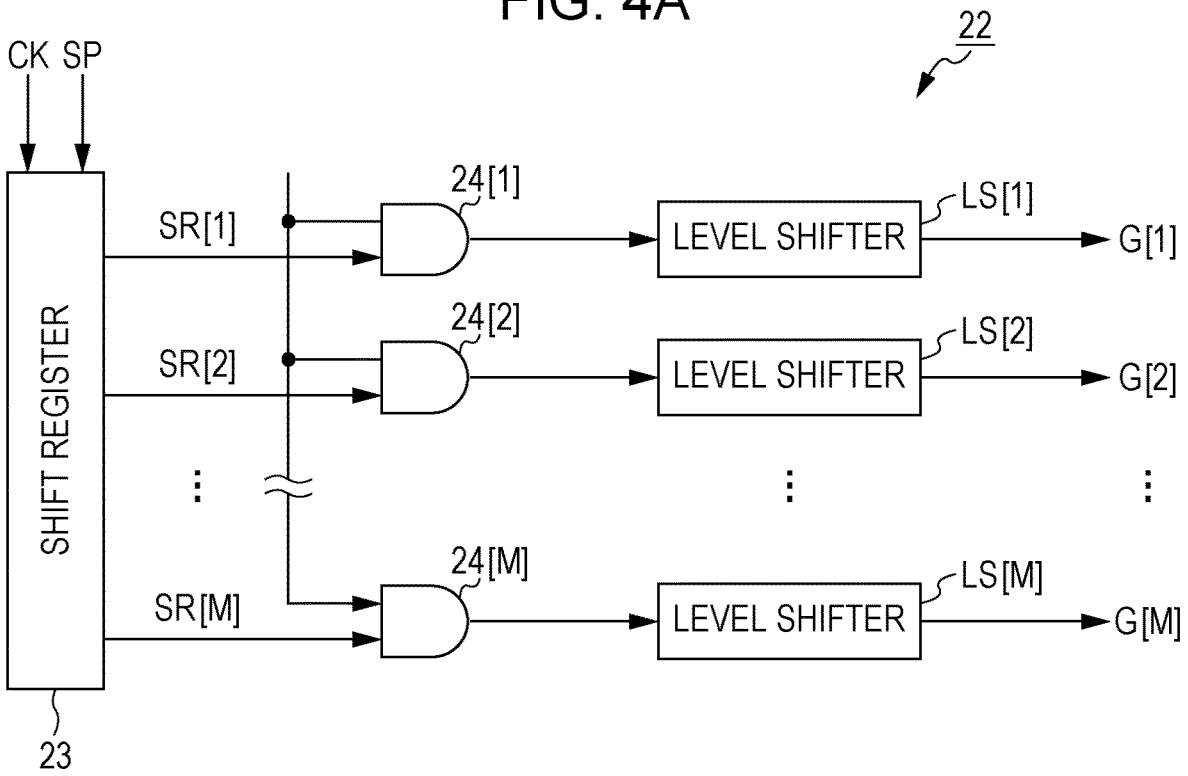
FIG. 4A is a block diagram illustrating the configuration of a scanning line drive circuit.
Figure 4B:
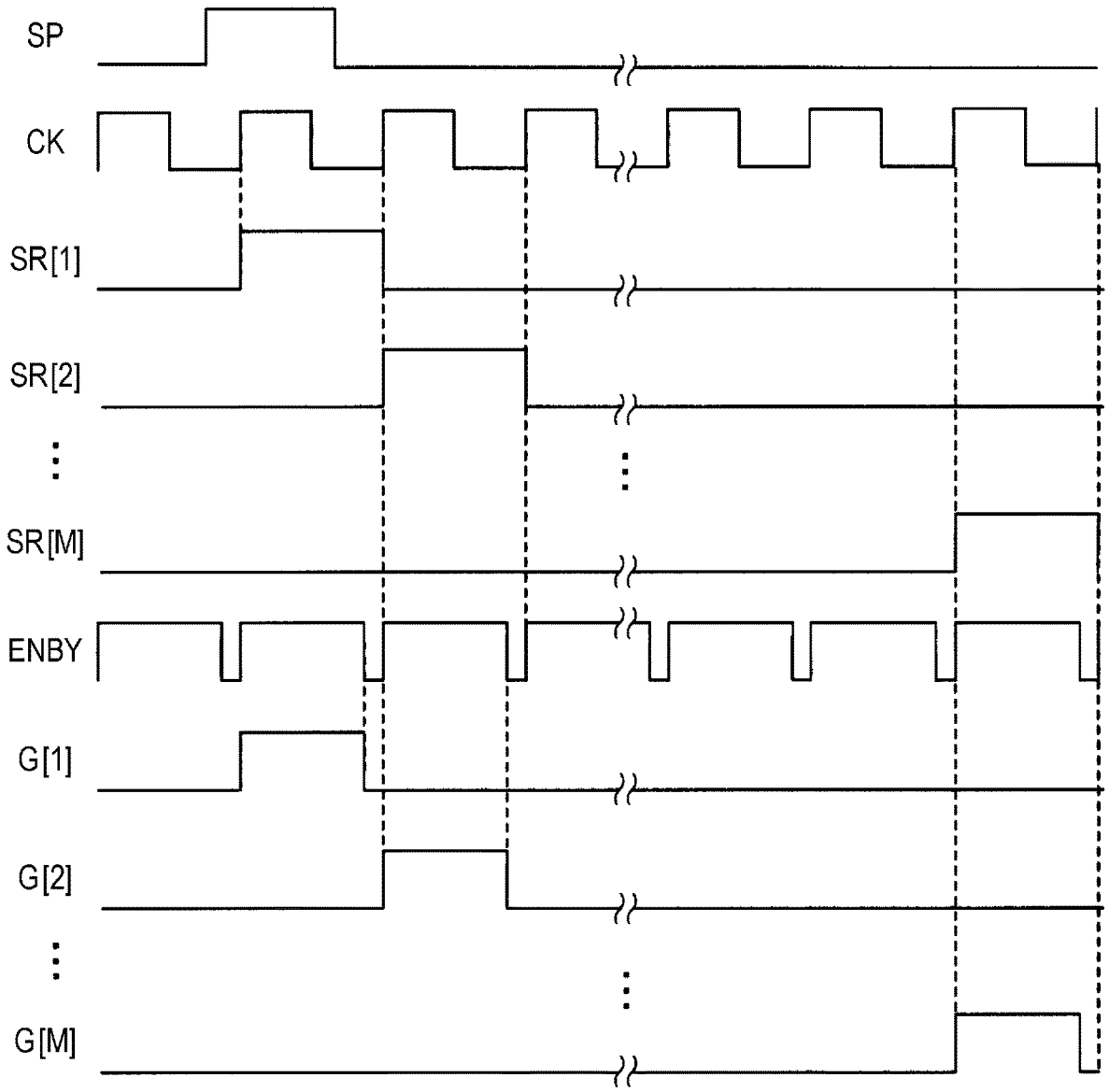
FIG. 4B is a diagram illustrating an operation timing of the scanning line drive circuit.

The scanning line drive circuit 22 generates the scanning signals G[1] to G[M] based on the start pulse SP, the clock signal CK, and the output control signal EN, and outputs the scanning signals G[1] to G[M] to the respective M scanning lines 12. FIG. 4A illustrates the circuit diagram of the scanning line drive circuit 22, and FIG. 4B illustrates the timing chart of the scanning line drive circuit 22.

As illustrated in FIG. 4A, the scanning line drive circuit 22 includes a shift register 23, M AND circuits 24[1] to 24[M], and M level shifters LS[1] to LS[M]. The shift register 23 shifts the start pulse SP in accordance with the clock signal CK, and generates shift signals SR[1] to SR[M]. The shift register 23 can be formed by connecting D flip-flops in multiple stages, for instance. The mth shift signal SR[m] is supplied to one input terminal of the AND circuit 24[*m*]. The output control signal EN is supplied to the other input terminal of the AND circuit 24[*m*]. The AND circuit 24[*m*] calculates a logical product of the shift signal SR[m] and the output control signal EN. The level shifter LS[m] performs level shift of an output signal of the AND circuit 24[*m*], and outputs the scanning signal G[m] to the mth scanning line 12. It is to be noted that although one output control signal EN is used in this example, multiple output control signals EN may be used depending on the condition of signal response. For the sake of description, it is assumed that no signal delay is caused by the AND circuit 24[*m*] and the level shifter LS[m].

Consequently, the scanning line drive circuit 22 sequentially makes the scanning signals G[1] to G[M] for the respective scanning lines 12 active every horizontal scanning period (1H) within the vertical scanning period V in synchronization with the horizontal Synchronizing signal Hs. However, in this example, the scanning signals G[1] to G[M] each provide a selection voltage in a selection period which is part of one horizontal scanning period, and each provide a non-selection voltage in a non-selection period other than the selection period. When a selection voltage is supplied to the pixel transistor Tr, the pixel transistor Tr becomes an ON state, and when a non-selecting voltage is supplied to the pixel transistor Tr, the pixel transistor Tr becomes an OFF state.

Here, the voltage of the scanning signal G[m] corresponding to the mth row becomes a selection voltage, and in a selection period during which the scanning line 12 corresponding to the row is selected, the pixel transistor Tr of each of the N pixel circuits PIX in the mth row becomes an ON state. Consequently, the N data lines 14 are electrically connected to the respective pixel electrodes 62 of the N pixel circuits PIX in the mth row via these pixel transistors Tr.

In this embodiment, the N data lines 14 in the pixel section 10 are divided into J wiring blocks B[1] to B[J], each of which has four adjacent data lines as a unit (J=N/4). In other words, the data lines 14 are grouped by wiring block B. The demultiplexers 57[1] to 57[J] correspond to the J wiring blocks B[1] to B[J], respectively. Since the data lines 14 are divided into groups of 4 lines as a unit in this embodiment, the data signal D[n] includes a data voltage for four pixels as described later.

The demultiplexer 57[*j*] serving as a selector is composed of four switches 58[1] to 58[4] (j is a natural number from 1 to J). In each demultiplexer 57[*j*], one of contact points of each of four switches 58[1] to 58[4] is connected in common. A common connection point between the one contact points of the four switches 58[1] to 58[4] of the demultiplexer 57[*j*] is connected to J VID signal lines 15. The J VID signal lines 15 are connected to the data line drive circuit 30 of the drive integrated circuit 200 via the flexible circuit substrate 300. The switches 58[1] to 58[4] are composed of an N-channel transistor, for instance.

In each demultiplexer 57[*j*], the other contact points of four switches 58[1] to 58[4] are respectively connected to four data lines 14 included in the wiring block B[j] corresponding to the demultiplexer 57[*j*].

ON and OFF of the four switches 58[1] to 58[4] of each demultiplexer 57[*j*] are switched by four selection signals S1 to S4, respectively. The four selection signals S1 to S4 are supplied from the control circuit 40 of the drive integrated circuit 200 via the flexible circuit substrate 300. The selection signals S1 to S4 specify start timing of output of the precharge voltage to the data lines 14. Here, for instance, when one selection signal S1 is at an active level, and other three selection signals S2 to S4 are at an inactive level, only J switches 58[1] belonging to respective demultiplexers 57[*j*] are ON. Therefore, each demultiplexer 57[*j*] outputs the data signals D[1] to D[J] on the J VID signal lines 15 to the first data line 14 of the wiring blocks B[1] to B[J]. Hereinafter, in a similar manner, each demultiplexer 57[*j*] outputs the data signals D[1] to D[J] on the J VID signal lines 15 to the second, third, and fourth data line 14 of the wiring blocks B[1] to B[J].

The control circuit 40 includes a frame memory, and has at least a memory space with M×N bits equivalent to the resolution of the pixel section 10, and stores and holds display data inputted from an external host CPU device (not illustrated) frame by frame. Here, the display data that defines gradation of the pixel section 10 is 64 gradation data of 6 bits, as an example. The display data read from the frame memory is serially transferred as an image signal to the data line drive circuit 30 via 6-bit bus.

It is to be noted that the control circuit 40 may include a line memory for at least one line. In this case, the line memory stores display data for one line, and transfers the display data to each pixel as an image signal.

The data line drive circuit 30 serving as a data line driver cooperates with the scanning line drive circuit 22 and outputs data signal to the data lines 14, the data signal to be supplied for each pixel row to which data is to be written. The data line drive circuit 30 generates a latch signal based on the selection signals S1 to S4 outputted from the control circuit 40, and sequentially latches a precharge signal and N 6-bit image signals supplied as serial data. The image signals are grouped by four pixels as time-series signals.

Figure 5:
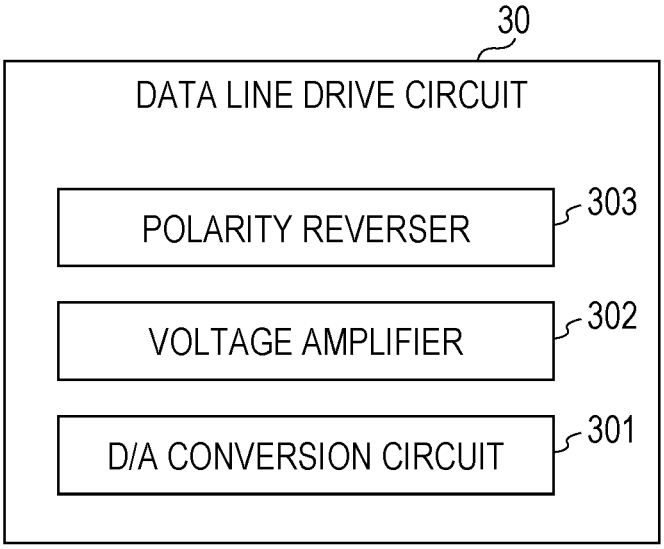
FIG. 5 is a block diagram illustrating the configuration of a data line drive circuit.

FIG. 5 is a block diagram illustrating the configuration of the data line drive circuit 30. As illustrated in FIG. 5, the data line drive circuit 30 includes a digital to analog (D/A) conversion circuit 301, a voltage amplifier 302, and a polarity reverser 303. The D/A conversion circuit 301 performs D/A conversion based on the grouped image signals, and an analog voltage which is generated by the analog voltage generation circuit 70 and in which a voltage value is set by the polarity reverser 303. Furthermore, the voltage amplifier 302 amplifies a voltage generated by the D/A conversion, and generates a data signal having a predetermined analog voltage. In this manner, time-series image signal in units of four pixels is converted to data signal D[n] having a predetermined data voltage. Similarly, the precharge signal is converted to a precharge data signal PD having a predetermined precharge voltage, and a pair of the precharge data signal PD and the data signal D[n] for four pixels is supplied to each VID signal line 15 in that order as the voltage of the data signal D[n] and the precharge voltage.

The polarity reverser 303 reverses the polarity of the voltage of the data signal D[n] every vertical scanning period V. Specifically, the polarity reverser 303 reverses the voltage of the data signal D[n] with respect to the central voltage of the data signal D[n] every vertical scanning period V. However, the period of polarity reversal may be set to any period, and for instance, may be a multiple of one vertical scanning period V. In this embodiment, the positive polarity refers to the case where the data signal D[n] is higher than the central voltage, and the negative polarity refers to the case where the data signal D[n] is lower than the central voltage. The polarity reverser 303 reverses the polarity of data voltage with a predetermined period.

Also, when the polarity of the data voltage is the positive polarity, the polarity reverser 303 outputs a first precharge voltage Vpp as the precharge voltage, and when the polarity of the data voltage is the negative polarity, the polarity reverser 303 outputs a second precharge voltage Vpm as the precharge voltage. That is, the voltage value of the precharge voltage when the data voltage has the positive polarity is different from the voltage value of the precharge voltage when the data voltage has the negative polarity. This is because the range of data voltage is different between the polarities, and thus an optimum voltage for obtaining both the effect of preliminary writing and the effect of reducing a vertical crosstalk is different between the polarities. In the following description, when the first precharge voltage Vpp and the second precharge voltage Vpm do not have to be distinguished, both are simply referred to as a precharge voltage.

The switches 58[1] to 58[4] of the demultiplexer 57[*j*] are conductively controlled (ON/OFF) by the selection signals S1 to S4 outputted from the control circuit 40, and is turned on at a predetermined timing. In an application period of a precharge signal, the switches 58[1] to 58[4] of the demultiplexer 57[*j*] are conductively controlled by the selection signals S1 to S4 outputted from the control circuit 40, are turned on all at once.

Thus, in one horizontal scanning period (1H), the precharge data signal PD and the data signal D[n] for four pixels supplied to each VID signal line 15 are time serially outputted to the data lines 14 by the switches 58[1] to 58[4].

In this embodiment, the polarity reversal driving is adopted. The precharge refers to writing a predetermined voltage is to each data line 14 before the data voltage of the data signal D[n] is written to each data lines 14. As described above, the precharge voltage when the polarity of the data voltage is the positive polarity is the first precharge voltage Vpp, and the precharge voltage when the polarity of the data voltage is the negative polarity is the second precharge voltage Vpm. For instance, the first precharge voltage Vpp in positive polarity driving is set to 4.0 V, and the central voltage Vc is set to 7.5 V. The common voltage LCCOM is set to 7.5 V. The second precharge voltage Vpm in negative polarity driving is set to 2.0 V. That is, the first precharge voltage Vpp when the data voltage has the positive polarity is higher than the second precharge voltage Vpm when the data voltage has the negative polarity.

It is to be noted that in this embodiment, the control circuit 40 performs control so that the supply timing of the precharge data signal PD at the time of negative polarity driving is delayed from the supply timing of the precharge data signal PD at the time of positive polarity driving in the polarity reversal driving.

Figure 6:
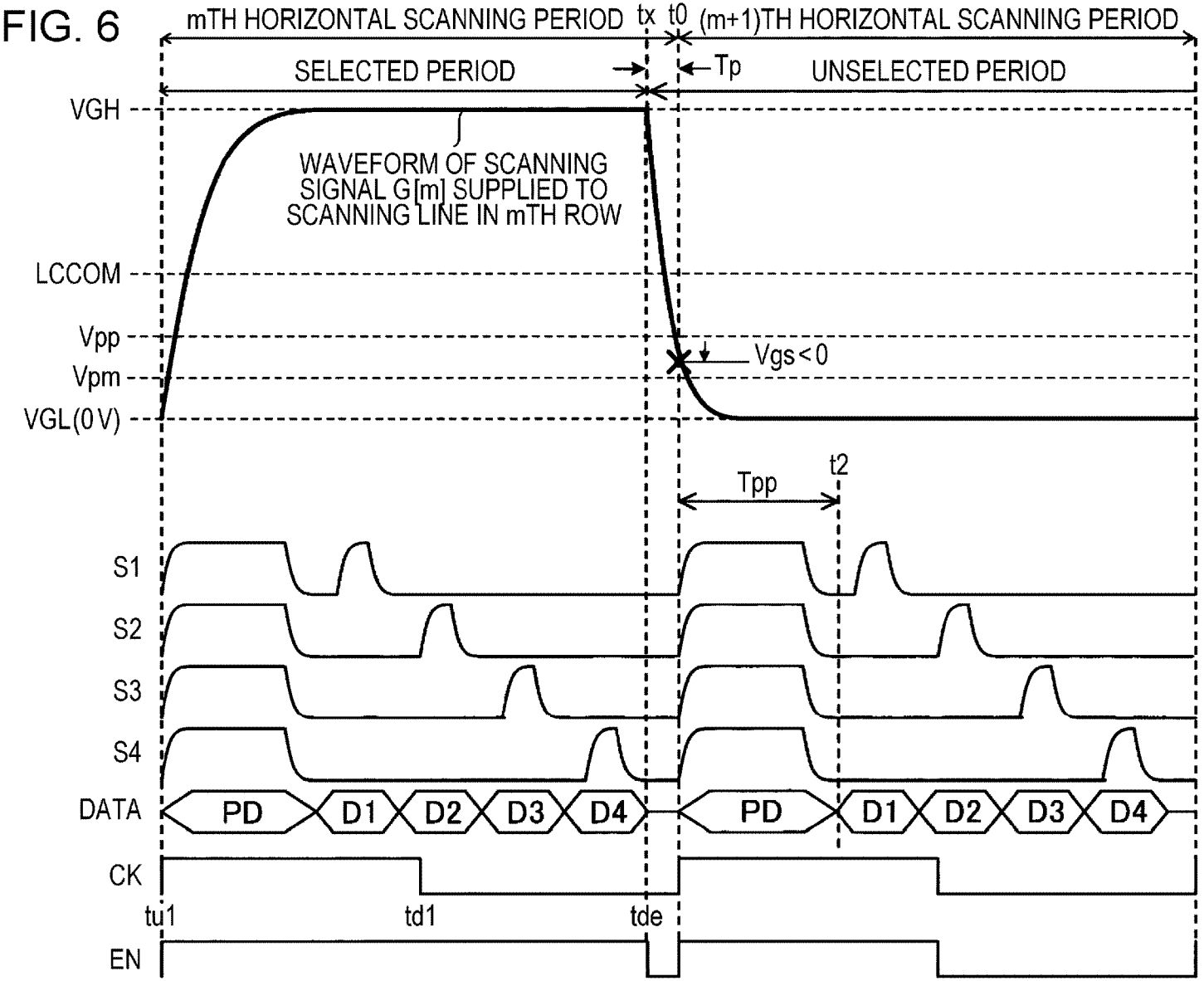
FIG. 6 is a diagram illustrating an example of supply timing of a precharge voltage at the time of positive polarity driving.
Figure 7A:
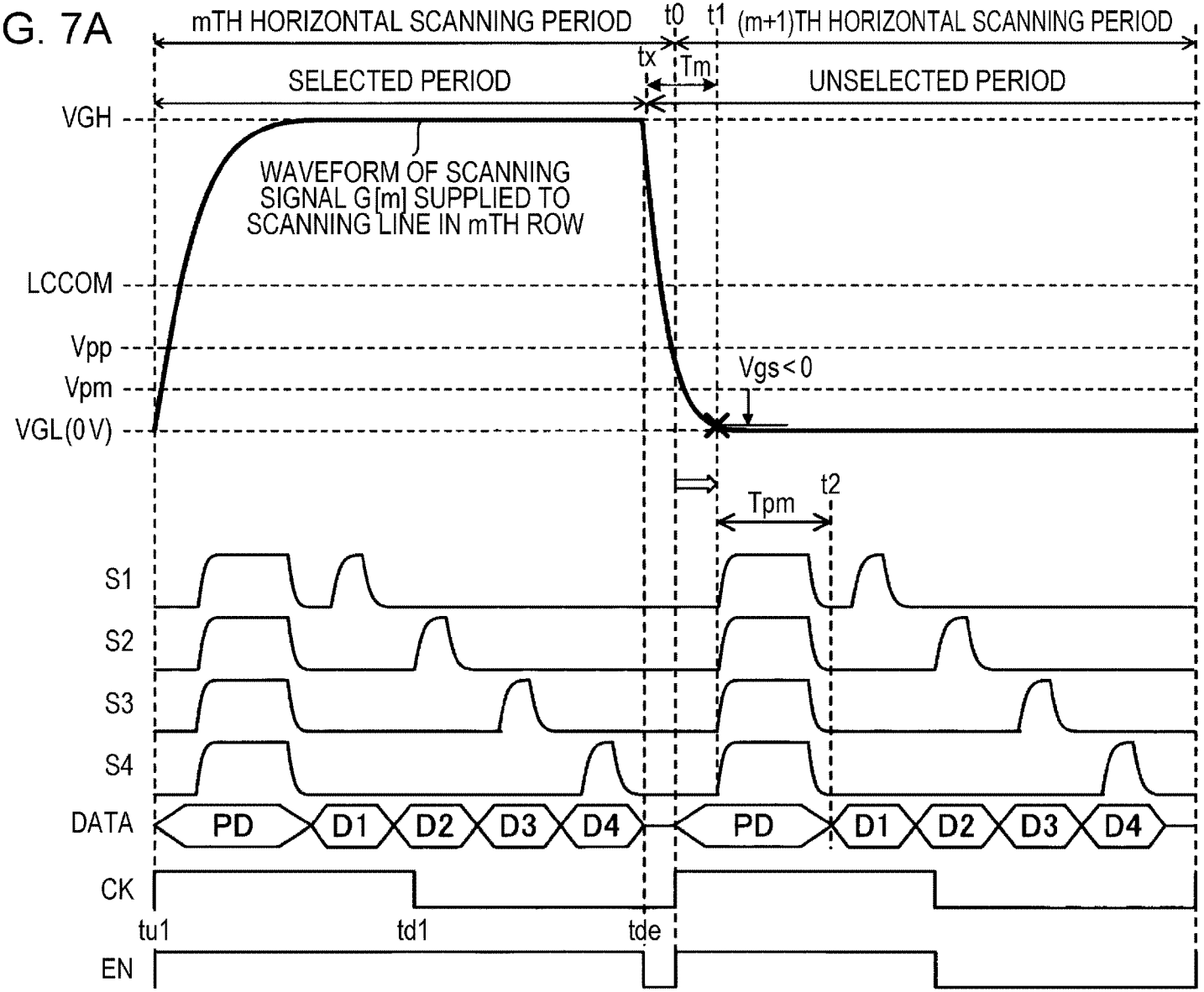
FIG. 7A is a diagram illustrating an example of supply timing of a precharge voltage at the time of negative polarity driving.
Figure 8:
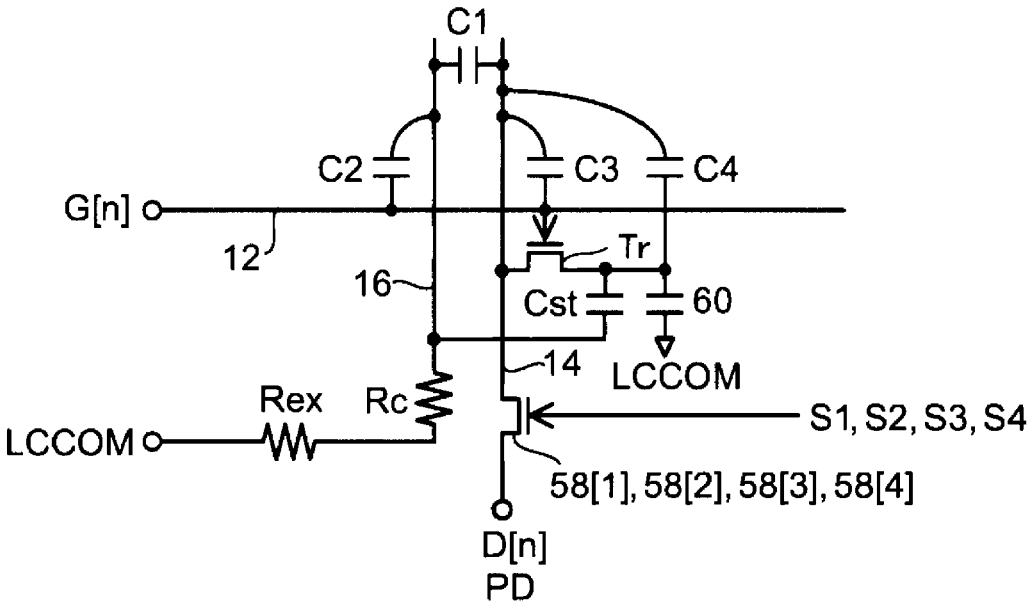
FIG. 8 is a circuit diagram of a pixel circuit including a capacitive line.
Figure 9:
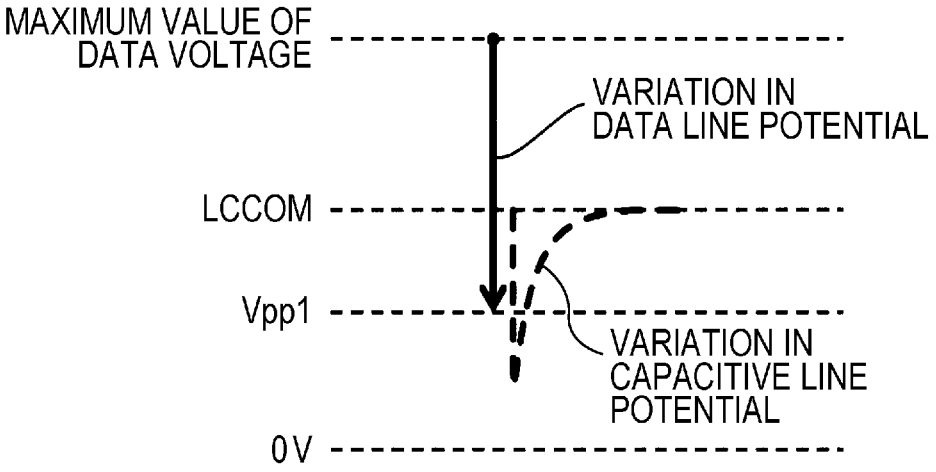
FIG. 9 is a diagram illustrating a relationship between variation in the potential of a data line and variation in the potential of a capacitive line at the time of positive polarity driving.
Figure 10:
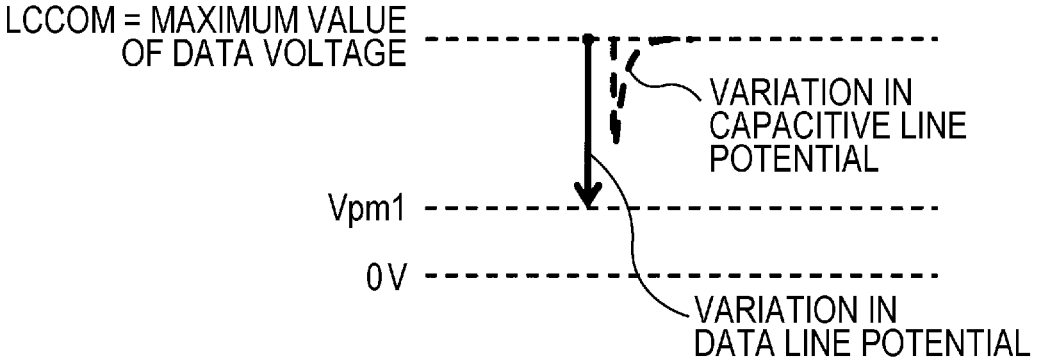
FIG. 10 is a diagram illustrating a relationship between variation in the potential of a data line and variation in the potential of a capacitive line at the time of negative polarity driving.

Here, the relationship between the scanning signal G[m] supplied to the scanning line 12 in the mth row and the supply timing of the precharge voltage will be described with reference to FIGS. 6 to 10. FIG. 6 is a diagram illustrating the supply timing of the first precharge voltage Vpp at the time of positive polarity driving. FIG. 7A is a diagram illustrating a supply timing of the second precharge voltage Vpm at the time of negative polarity driving. FIG. 8 is a circuit diagram of the pixel circuit PIX including a capacitive line 16. FIG. 9 is a diagram illustrating a relationship between variation in the potential of the data line 14 and variation in the potential of the capacitive line 16 at the time of positive polarity driving. FIG. 10 is a diagram illustrating a relationship between variation in the potential of the data line 14 and variation in the potential of the capacitive line 16 at the time of negative polarity driving.

As illustrated in FIG. 6, the scanning signal G[m] supplied to the scanning line 12 in the mth row becomes a selection voltage VGH for selecting the scanning line 12 in the mth row in a selection period, and is switched to a non-selection voltage VGL (0 V) for not selecting the scanning line 12 in the mth row in a non-selection period. However, in the high-resolution electro-optical panel 100 with a great number of pixels as in this embodiment, the parasitic capacitance of the scanning lines 12 is increased. As illustrated in FIG. 8, in the scanning line 12, a capacitance C2 between the scanning line 12 and the capacitive line 16, and a capacitance C3 between the scanning line 12 and data line 14 are present. Therefore, as the number of pixels is increased, each parasitic capacitance of the scanning line 12 is increased. Therefore, as illustrated in FIG. 6, at timing t0 which is the completion time of the mth horizontal scanning period, the voltage of the scanning signal G[m] does not reach the non-selection voltage VGL (0 V), and is in transition from the selection voltage VGH to the non-selection voltage VGL (0 V).

At the time of positive polarity driving, even when the first precharge voltage Vpp is supplied to the data line 14 at the timing t0 which is the completion time of the mth horizontal scanning period, the voltage of the scanning signal G[m] at the timing t0 has a value lower than the first precharge voltage Vpp. Therefore, even when the first precharge voltage Vpp is supplied to the data line 14 at the timing t0, a voltage Vgs between the gate and the source of the pixel transistor Tr of the pixel circuit PIX has a negative value. For this reason, each pixel transistor Tr in the mth row is turned off at the timing t0. Therefore, even when the first precharge voltage Vpp is supplied to the data line 14 at the timing t0 which is the start time of the (m+1)th horizontal scanning period, the pixel transistor Tr of the pixel circuit PIX corresponding to each scanning line 12 in the mth row does not become an ON state.

However, as illustrated in FIG. 7A, at the time of negative polarity driving, when the second precharge voltage Vpm is supplied to the data line 14 at the timing t0 which is the completion time of the mth horizontal scanning period, the voltage in transition at the timing t0 of the scanning signal G[m] has a value higher than the second precharge voltage Vpm. Therefore, when the second precharge voltage Vpm is supplied to the data line 14 at the timing t0, the pixel transistor Tr of the pixel circuit PIX corresponding to each scanning line 12 in the mth row becomes an ON state. Consequently, the second precharge voltage Vpm supplied before writing of a data voltage according to gradation of the pixel circuit PIX corresponding to each scanning line 12 in the (m+1)th row causes variation in the data voltage written to the pixel circuit PIX corresponding to each scanning line 12 in the mth row, and thus the image quality is reduced.

Thus, in this embodiment, as illustrated in FIG. 7A, in the (m+1)th horizontal scanning period, the control circuit 40 sets the selection signals S1 to S4 to an ON state so that the supply timing of the second precharge voltage Vpm to the data line 14 matches a timing t1 that is the timing when the voltage of the scanning signal G[m] supplied to each scanning line 12 in the mth row reaches the non-selection voltage VGL. In other words, in this embodiment, the supply timing of the second precharge voltage Vpm at the time of negative polarity driving is delayed from the timing t0 which is the timing of completion of the mth horizontal scanning period. By performing control in this manner, at the timing t1, the voltage of the scanning signal G[m] has a value lower than the second precharge voltage Vpm. Therefore, even when the second precharge voltage Vpm is supplied to the data line 14 at the timing t1, the pixel transistor Tr of the pixel circuit PIX corresponding to each scanning line 12 in the mth row does not become an ON state. Consequently, the second precharge voltage Vpm supplied before writing of a data voltage according to gradation of the pixel circuit PIX corresponding to each scanning line 12 in the (m+1)th row causes no variation in the data voltage written to the pixel circuit PIX corresponding to each scanning line 12 in the mth row, and thus a favorable display quality can be maintained.

In other words, the control circuit 40 changes the elapsed time, according to the polarity of the data voltage, from the start of transition of the scanning signal G[m] from the selection voltage VGH to the non-selection voltage VGL at timing tx until an output of the precharge voltage to the data line 14, the scanning signal G[m] being outputted to each scanning line 12 in the mth row.

Here, the timing tx of the start of transition of the scanning signal G[m] from the selection voltage VGH to the non-selection voltage VGL matches a timing tde of transition of the output control signal EN from active to inactive, the scanning signal G[m] being outputted to each scanning line 12 in the mth row. In other words, the control circuit 40 changes the elapsed time, according to the polarity of the data voltage, from the timing (tul or tde illustrated in FIG. 6, FIG. 7A) of transition of the output control signal EN from one level to the other level until an output of the precharge voltage to the data line 14.

More specifically, the control circuit 40 changes the elapsed time, according to the polarity of the data voltage, from the timing (tde illustrated in FIG. 6, FIG. 7A) of transition of the output control signal EN from active to inactive until an output of the precharge voltage to the data line 14.

Also, the control circuit 40 makes an elapsed time Tm (see FIG. 7A) for writing a data voltage with the negative polarity to the pixel circuit PIX longer than an elapsed time Tp (see FIG. 6) for writing a data voltage with the positive polarity to the pixel circuit PIX.

When the data voltage has the positive polarity, the timing t0 illustrated in FIG. 6 is the start timing of output of the precharge voltage to the data lines 14 specified by the selection signals S1 to S4. When the data voltage has the positive polarity, the timing t1 illustrated in FIG. 7A is the start timing of output of the precharge voltage to the data lines 14 specified by the selection signals S1 to S4. Also, the scanning signal G[m] in the mth row illustrated in FIGS. 6 and 7A is obtained by shifting the start pulse SP in accordance with the clock signal CK. Thus, the control circuit 40 changes the elapsed time, according to the polarity of the data voltage, from timing (tul or tdl illustrated in FIGS. 6 and 7A) of transition of the clock signal CK from one level to the other level until start timing of output of the precharge voltage to the data lines 14 specified by the selection signals S1 to S4.

The above-described control of supply of the precharge voltage makes a precharge period Tpm at the time of negative polarity driving illustrated in FIG. 7A shorter than a precharge period Tpp at the time of positive polarity driving illustrated in FIG. 6. Although securing the precharge period is necessary for stability of the potential of the capacitive line 16, the variation in the potential of the capacitive line at the time of negative polarity driving is smaller than the variation in the potential of the capacitive line at the time of positive polarity driving, and thus the precharge period Tpm at the time of negative polarity driving can be shorter than the precharge period Tpp at the time of positive polarity driving, and a favorable display quality can be maintained. The precharge voltage Vpm at the time of negative polarity driving is lower than the precharge voltage Vpp at the time of positive polarity driving. Thus, when an N-channel transistor is used for the pixel transistor Tr of the pixel circuit PIX and the switches 58[1] to 58[4] of the demultiplexer 57[*j*], at the time of negative polarity driving, an operation of writing a precharge voltage is performed with a gate voltage higher than the gate voltage at the time of positive polarity driving. This is also a reason why the precharge period Tpp can be shortened.

Also, in the example illustrated in FIG. 7A, the data line drive circuit 30 outputs the precharge voltage in a period from at least the timing t0 of the start of the mth horizontal scanning period until timing t2 of completion of the precharge period Tpm, and the demultiplexer 57 outputs the precharge data signal PD outputted from the data line drive circuit 30 to the data lines 14 in the precharge period Tpm. The timing t0 of the start of output of the precharge data signal PD by the data line drive circuit 30 is earlier than the start timing t1 specified by the selection signals S1 to S4.

As illustrated in FIG. 8, the data line 14 and the capacitive line 16 are coupled via a coupling capacitor C1, and the capacitive line 16 is also connected to the retention capacitor Cst of the pixel circuit PIX. The capacitive line 16 is connected to the power supply LCCOM via an external resistance Rex due to various factors and a wire resistance Rc of the capacitive line 16 itself, thereby exhibiting potential behavior having a time constant. Therefore, when the potential of the data line 14 is varied, the potential of the capacitive line 16 is also varied based on the above-mentioned time constant. As illustrated in FIG. 9, in the precharge period Tpp at the time of positive polarity driving, the potential of data line 14 is varied from a maximum value of the data voltage to the first precharge voltage Vpp at most. In this case, the potential of the capacitive line 16 is once significantly reduced from the common voltage LCCOM, and is returned to the common voltage LCCOM again. However, as illustrated in FIG. 10, in the precharge period Tpm at the time of negative polarity driving, the voltage difference between the common voltage LCCOM which is a maximum value of the data voltage and the second precharge voltage Vpm is smaller than the voltage difference between a maximum value of the data voltage and the first precharge voltage Vpp at the time of positive polarity driving. Consequently, the variation in the potential of the capacitive line 16 in the precharge period Tpm at the time of negative polarity driving is smaller than the variation in the potential of the capacitive line 16 in the precharge period Tpp at the time of positive polarity driving. Therefore, even when the precharge period Tpm at the time of negative polarity driving is made shorter than the precharge period Tpp at the time of positive polarity driving, the potential of the capacitance line 16 is stabilized, and a favorable display quality can be maintained by writing a desired data voltage to the pixel circuit PIX.

Figure 7B:
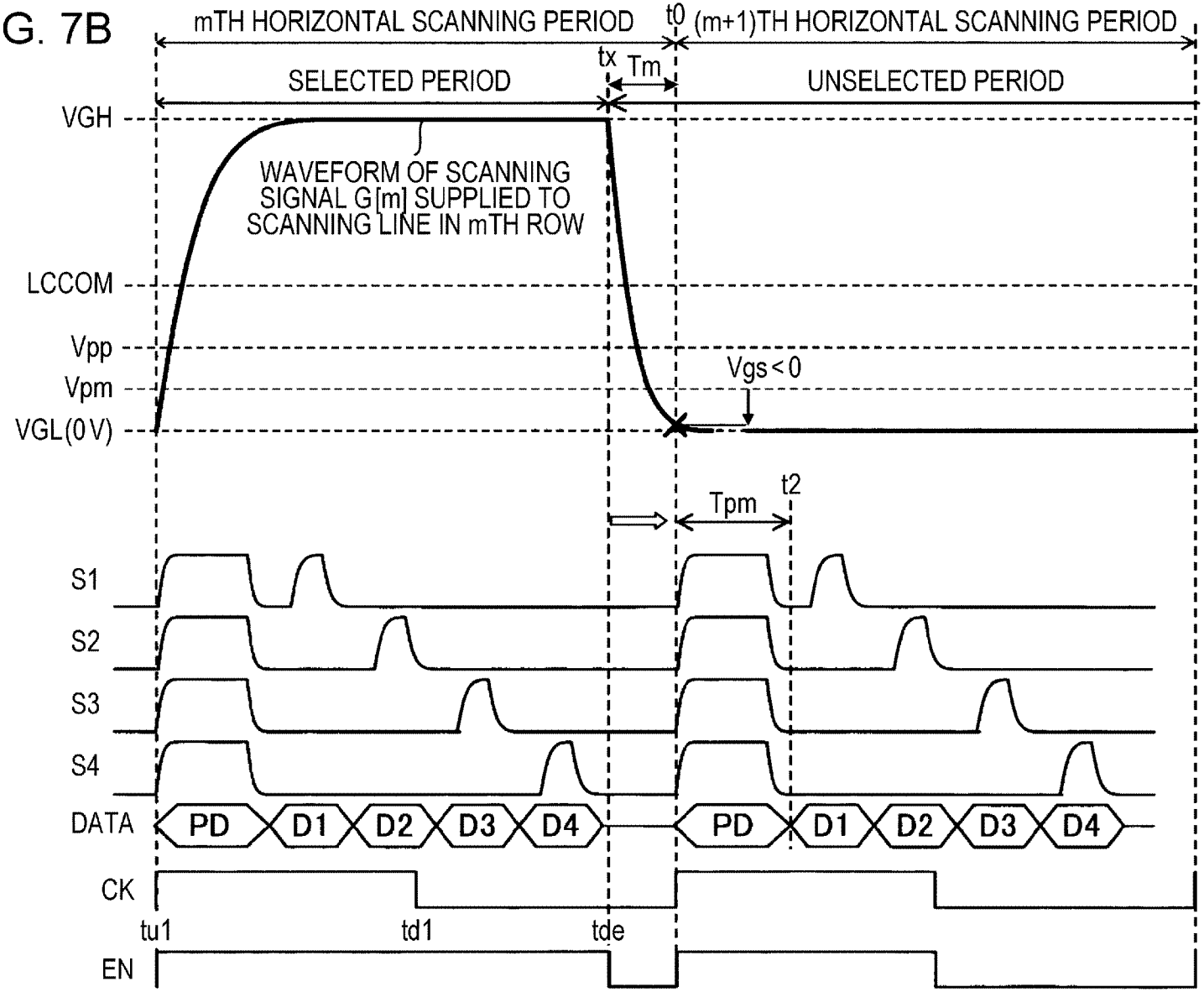
FIG. 7B is a diagram illustrating an example of supply timing of a precharge voltage at the time of negative polarity driving.

It is to be noted that as illustrated in FIGS. 7A and 7B, at the time of negative polarity driving, even when the second precharge voltage Vpm is supplied to the data line 14 at the timing t0 which is the completion time of the mth horizontal scanning period, the voltage at the timing t0 of the scanning signal G[m] has a value higher than the second precharge voltage Vpm. Therefore, when the second precharge voltage Vpm is supplied to data line 14 at the timing t0, the pixel transistor Tr of the pixel circuit PIX corresponding to the scanning line 12 in the mth row becomes an ON state. Consequently, the second precharge voltage Vpm supplied before writing of a data voltage according to gradation of the pixel circuit PIX corresponding to each scanning line 12 in the (m+1)th row causes variation in the data voltage written to the pixel circuit PIX corresponding to each scanning line 12 in the mth row, and thus the image quality is reduced.

Thus, in this embodiment, as illustrated in FIG. 7A, in the (m+1)th horizontal scanning period, the control circuit 40 sets the selection signals S1 to S4 to an ON state so that the supply timing of the second precharge voltage Vpm to the data line 14 matches a timing t1 that is the timing when the voltage of the scanning signal G[m] supplied to each scanning line 12 in the mth row reaches the non-selection voltage VGL. In other words, in this embodiment, the supply timing of the second precharge voltage Vpm at the time of negative polarity driving is delayed from the timing t0 which is the timing of completion of the mth horizontal scanning period. By performing control in this manner, at the timing t1, the voltage of the scanning signal G[m] has a value lower than the second precharge voltage Vpm. Therefore, even when the second precharge voltage Vpm is supplied to the data line 14 at the timing t1, the pixel transistor Tr of the pixel circuit PIX corresponding to each scanning line 12 in the mth row does not become an ON state. Consequently, the second precharge voltage Vpm supplied before writing of a data voltage according to gradation of the pixel circuit PIX corresponding to each scanning line 12 in the (m+1)th row causes no variation in the data voltage written to the pixel circuit PIX corresponding to each scanning line 12 in the mth row, and thus a favorable display quality can be maintained.

In other words, the control circuit 40 changes the elapsed time, according to the polarity of the data voltage, from the start of transition of the scanning signal G[m] from the selection voltage VGH to the non-selection voltage VGL at timing tx until an output of the precharge voltage to the data line 14, the scanning signal G[m] being outputted to each scanning line 12 in the mth row.

Here, the timing tx of the start of transition of the scanning signal G[m] from the selection voltage VGH to the non-selection voltage VGL matches a timing tde of transition of the output control signal EN from active to inactive, the scanning signal G[m] being outputted to each scanning line 12 in the mth row. In other words, the control circuit 40 changes the elapsed time, according to the polarity of the data voltage, from the timing (tul or tde illustrated in FIG. 6, FIG. 7A) of transition of the output control signal EN from one level to the other level until an output of the precharge voltage to the data line 14.

More specifically, the control circuit 40 changes the elapsed time, according to the polarity of the data voltage, from the timing (tde illustrated in FIG. 6, FIG. 7A) of transition of the output control signal EN from active to inactive until an output of the precharge voltage to the data line 14.

Also, the control circuit 40 makes an elapsed time Tm (see FIG. 7A) for writing a data voltage with the negative polarity to the pixel circuit PIX longer than an elapsed time Tp (see FIG. 6) for writing a data voltage with the positive polarity to the pixel circuit PIX.

In the above-described example of negative polarity driving, as illustrated in FIG. 7A, the timing of application of the precharge voltage to the data lines 14 in the (m+1)th horizontal scanning period is the timing t1 which is delayed from the timing t0 of the start of the (m+1)th horizontal scanning period. The reason why application of the precharge voltage to the data lines 14 is started at the timing t1 is that the voltage of the mth scanning line 12 at the timing t1 allows OFF of the pixel transistor Tr to be maintained depending on a relationship with the precharge voltage. Thus, when the voltage of the mth scanning line 12 allows OFF of the pixel transistor Tr to be maintained at the timing of the start of application of the precharge voltage to the data lines 14, the timing of the start of application of the precharge voltage to the data lines 14 may be earlier than the timing t1.

FIG. 7B is a diagram illustrating an example of supply timing of a precharge voltage at the time of negative polarity driving. The timing tx at which the scanning signal G[m] starts transition from the selection voltage VGH to the non-selection voltage VGL, and the output control signal EN makes transition from active to inactive is set earlier than the timing tx at the time of positive polarity driving (see FIG. 6). Therefore, at the time of negative polarity driving, the time during which the voltage of the scanning line 12 in the mth row is reduced can be longer than the time at the time of positive polarity driving.

In other words, the control circuit 40 changes the elapsed time from, according to the polarity of the data voltage, the timing tx of transition of the output control signal EN from active to inactive until start timing of output of the precharge voltage to the data lines 14 specified by the selection signals S1 to S4.

As described above, according to this embodiment, at the time of negative polarity driving, control is performed so that supply timing of the precharge voltage Vpm for selecting a scanning line 12 matches the timing when the voltage of the scanning line 12 selected immediately before the selecting reaches the non-selection voltage. By performing control in this manner, a favorable display quality can be maintained without affecting the potential of the pixel circuit PIX for which writing is completed.

Second Embodiment

Figure 11:
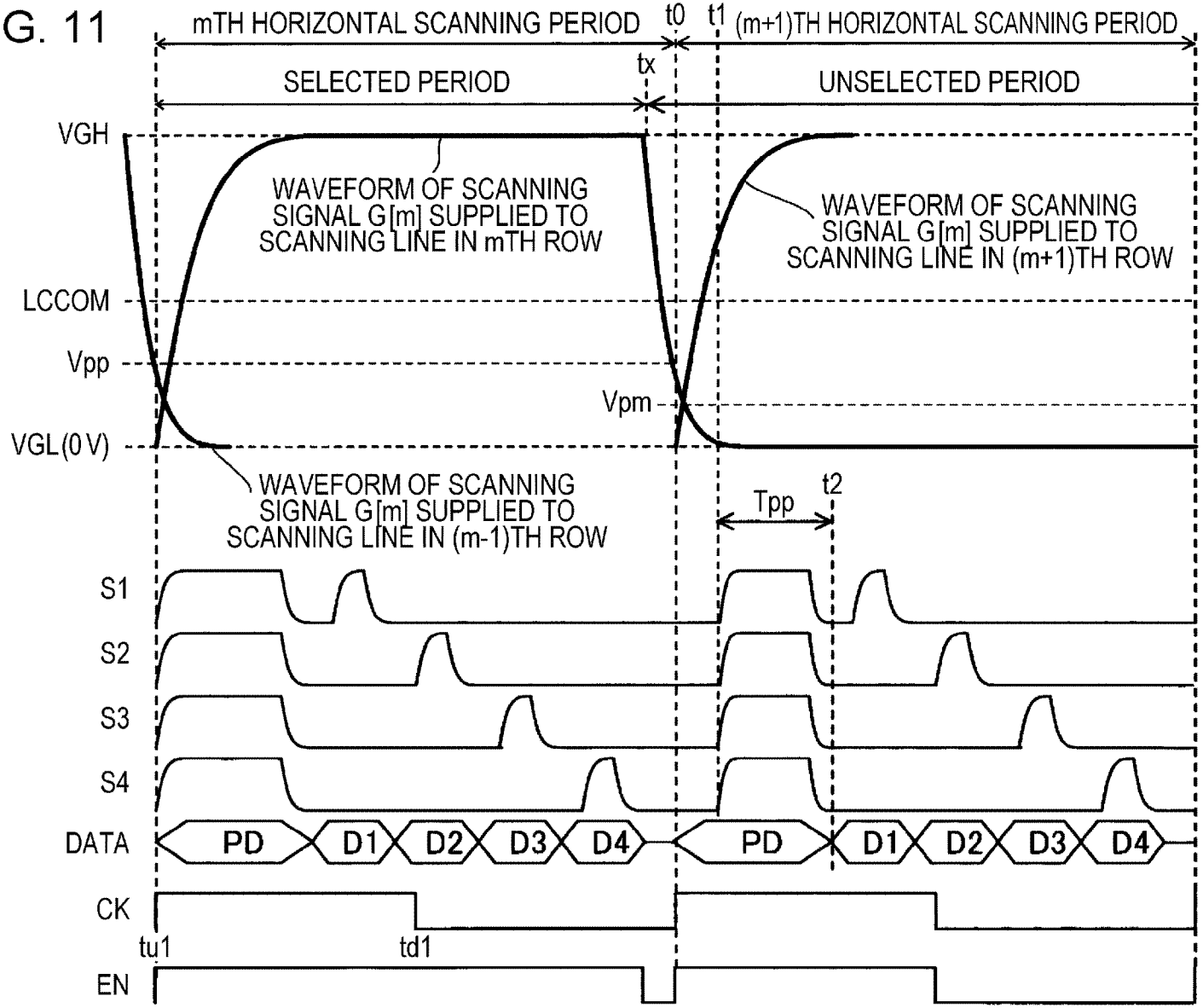
FIG. 11 is a diagram illustrating an example of supply timing of a precharge voltage in a second embodiment of the invention.

Next, a second embodiment of the invention will be described with reference to FIG. 11. FIG. 11 is a diagram illustrating supply timing of a precharge voltage in this embodiment. In this embodiment, polarity reversal is performed every horizontal scanning period (1H) and not every vertical scanning period (1V). In the example illustrated in FIG. 11, the positive polarity driving is performed in the mth horizontal scanning period, and the negative polarity driving is performed in the (m+1)th horizontal scanning period. Also in this case, in the (m+1)th horizontal scanning period in which the negative polarity driving is performed, the supply timing of the second precharge voltage Vpm is delayed from the timing t0 which is the timing of completion of the mth horizontal scanning period. In other words, the control circuit 40 sets the selection signals S1 to S4 to an ON state so that the supply timing of the second precharge voltage Vpm matches the timing when the voltage of the scanning signal G[m] supplied to each scanning line 12 in the mth row reaches the non-selection voltage VGL.

As described above, even when polarity reversal is performed every horizontal scanning period, at the time of negative polarity driving, control is performed so that supply timing of the precharge voltage Vpm for selecting a scanning line 12 matches the timing when the voltage of the scanning line 12 selected immediately before the selecting reaches the non-selection voltage. By performing control in this manner, a favorable display quality can be maintained without affecting the potential of the pixel circuit PIX for which writing is completed.

Third Embodiment

Figure 12A:
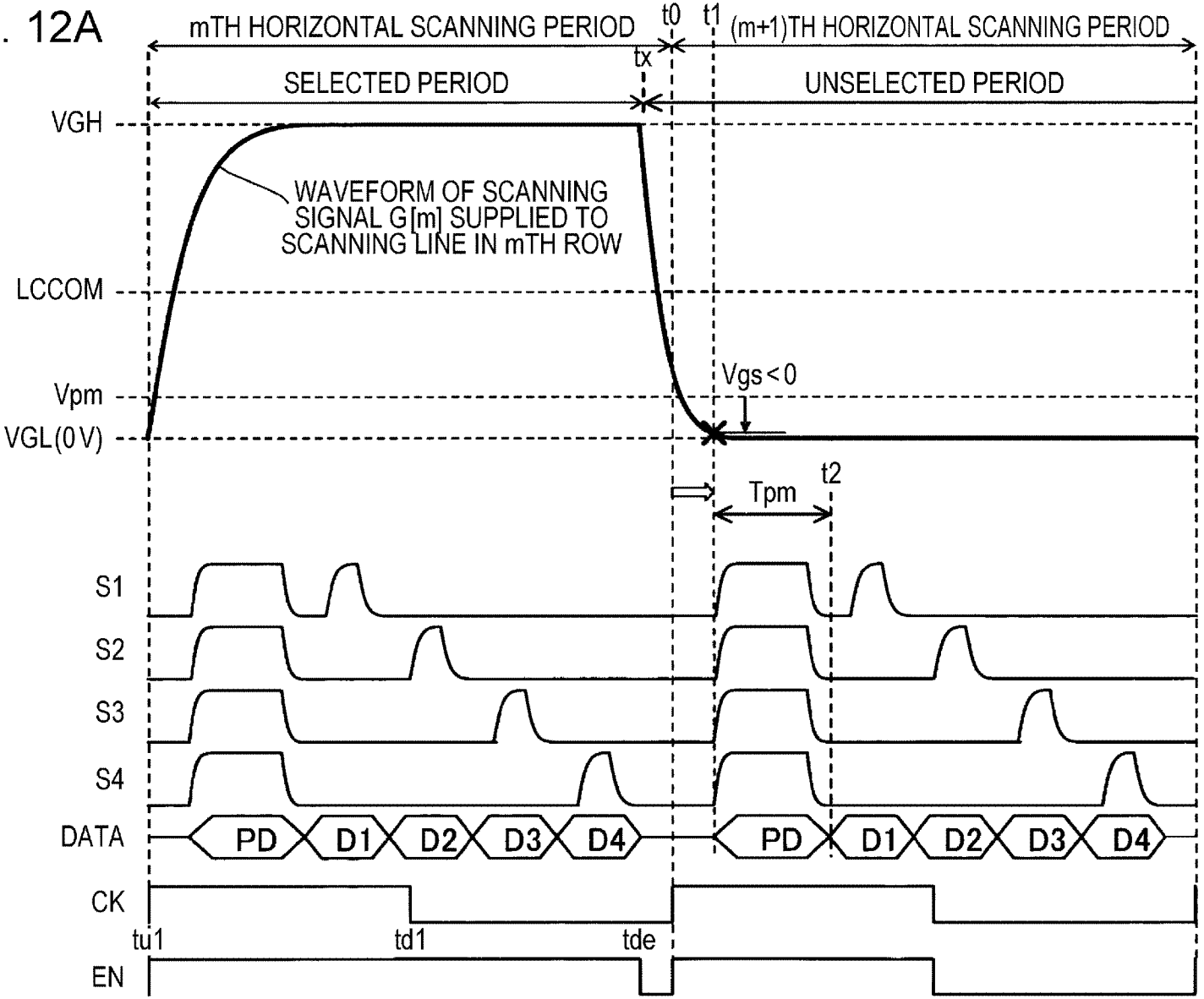
FIG. 12A is a diagram illustrating an example of supply timing of a precharge voltage in a third embodiment of the invention.

Next, a third embodiment of the invention will be described with reference to FIG. 12A. FIG. 12A is a diagram illustrating an example of supply timing of the second precharge voltage Vpm at the time of negative polarity driving in a third embodiment. In this embodiment, similarly to the first embodiment, polarity reversal is performed every horizontal scanning period (1H). As illustrated in FIG. 12A, also in this embodiment, the timing for setting the selection signals S1 to S4 to an ON state in the precharge period Tpm matches the timing t1 that is the timing when the voltage of the scanning signal G[m] supplied to each scanning line 12 in the mth row reaches the non-selection voltage VGL. Furthermore, in this embodiment, the control circuit 40 controls the data line drive circuit 30 so that the precharge data signal PD is outputted in the precharge period Tpm. In other words, a period in which the data line drive circuit 30 outputs the precharge voltage is approximately equal to a period in which the selection signals S1 to S4 become active (high-level in this example) in order to output the precharge voltage to the data lines 14.

Consequently, in this embodiment, control is performed so that the start timing of the precharge period Tpm at the time of negative polarity driving for selecting a scanning line 12 matches the timing when the voltage of the scanning line 12 selected immediately before the selecting reaches the non-selection voltage. By performing control in this manner, a favorable display quality can be maintained without affecting the potential of the pixel circuit PIX for which writing is completed. According to this embodiment, only in the precharge period Tpm in which the demultiplexer 57 becomes an ON state, and the data lines 14 and the output terminals of the data line drive circuit 30 are connected, the data line drive circuit 30 outputs the precharge voltage. Consequently, power consumption can be reduced by shortening the operation time of the data line drive circuit 30, and reliability can be improved by reducing the amount of heat generation of the data line drive circuit 30.

Figure 12B:
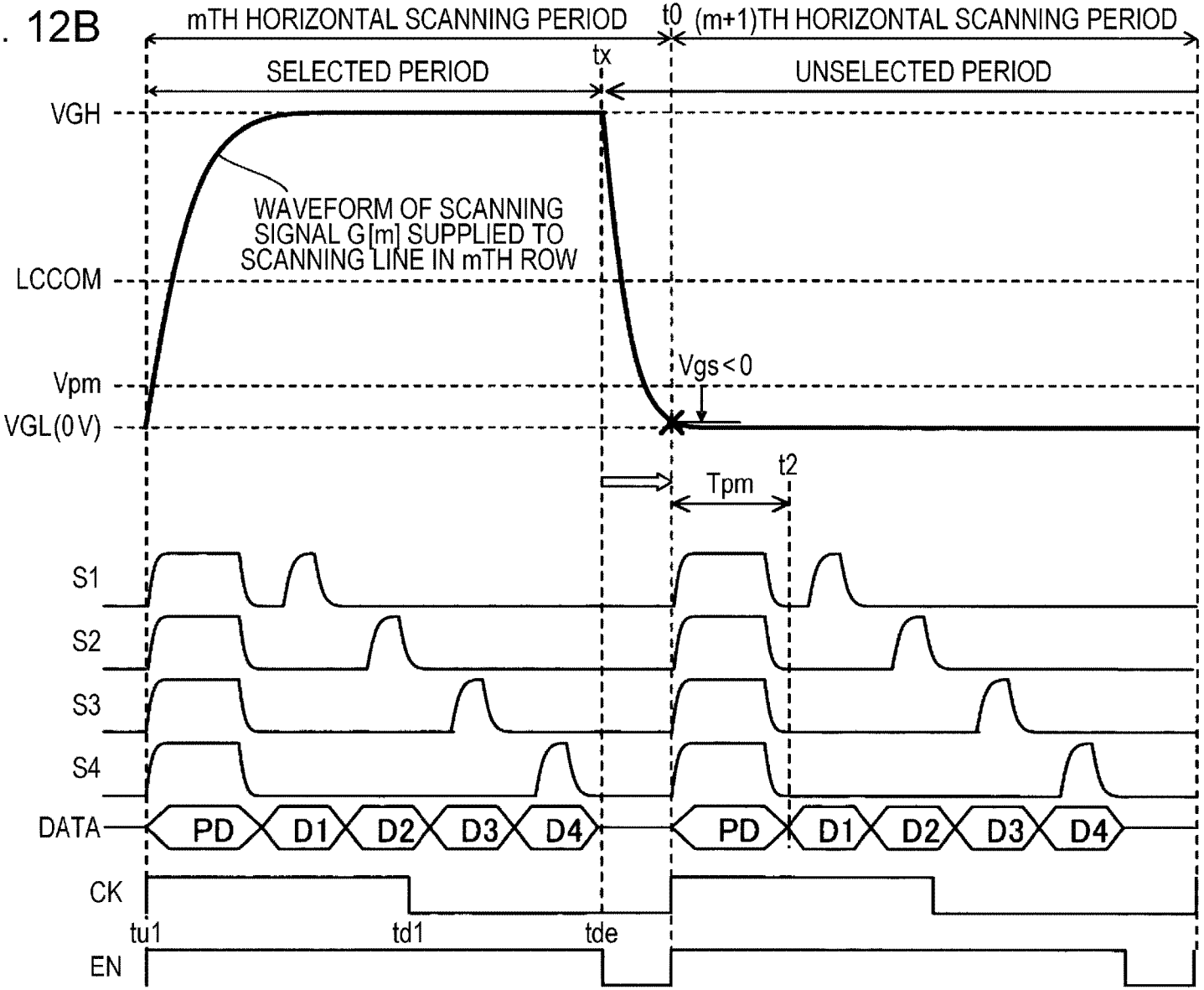
FIG. 12B is a diagram illustrating an example of supply timing of a precharge voltage in the third embodiment.

In the example described above, as illustrated in FIG. 12A, the timing of application of the precharge voltage to the data lines 14 in the (m+1)th horizontal scanning period is the timing t1 which is delayed from the timing t0 of the start of the (m+1)th horizontal scanning period. However, as illustrated in FIG. 12B, the timing of application of the precharge voltage to the data lines 14 in the (m+1)th horizontal scanning period may be matched with the timing t0 of the start of the (m+1)th horizontal scanning period.

In this case, the timing tx at which the scanning signal G[m] starts transition from the selection voltage VGH to the non-selection voltage VGL, and the output control signal EN makes transition from active to inactive is set earlier than the timing tx at the time of positive polarity driving (see FIG. 6). Therefore, at the time of negative polarity driving, the time during which the voltage of the scanning line 12 in the mth row is reduced can be longer than the time at the time of positive polarity driving.

In other words, the control circuit 40 changes the elapsed time, according to the polarity of the data voltage, from the timing tx of transition of the output control signal EN from active to inactive until start timing of output of the precharge voltage to the data lines 14 specified by the selection signals S1 to S4.

Modifications

The invention is not limited to the embodiments described above, and for instance, various modifications described below may be made. It goes without saying that the embodiments and the modifications may be combined as needed.

(1) In the embodiments described above, an N-channel transistor is used as the pixel transistor Tr of the pixel circuit PIX. At the time of negative polarity driving which is part of the polarity reversal driving, control is performed so that the start timing of the precharge period for selecting a scanning line 12 matches the timing when the voltage of the scanning line 12 selected immediately before the selecting reaches the non-selection voltage. However, the invention is not limited to such an aspect and is also applicable, for instance, when a P-channel transistor is used as the pixel transistor Tr of the pixel circuit PIX, and the precharge voltage is lower than the voltage in transition at the completion time of a horizontal scanning period in the scanning line 12 selected immediately before a scanning line 12 at the time of positive polarity driving. In this case, control may be performed so that supply timing of the precharge voltage for selecting a scanning line 12 at the time of positive polarity driving matches the timing when the voltage of the scanning line 12 selected immediately before the selecting reaches the non-selection voltage.

(2) In the embodiments described above, an aspect, in which the voltage is constant in the precharge period, has been described. However, the invention is not limited to such an aspect, and is applicable to, for instance, what is called two-stage precharge in which a first stage precharge and a second stage precharge are performed in a precharge period. In this case, control may be performed so that supply timing of the first stage precharge voltage at the time of negative polarity driving for selecting a scanning line 12 matches the timing when the voltage of the scanning line 12 selected immediately before the selecting reaches the non-selection voltage.

(3) In the embodiments described above, a liquid crystal is taken as an example of an electro-optical material. However, the invention is applicable to an electro-optical device using an electro-optical material other than the liquid crystal. The electro-optical material is such that optical characteristics, such as a transmittance and a luminance are changed by supply of an electrical signal (a current signal or a voltage signal). For instance, similarly to the above-described embodiments, the invention is also applicable to a display panel using a light emitting device, such as an organic electroluminescent (EL), an inorganic EL, and a light emitting polymer. Also, similarly to the above-described embodiments, the invention is also applicable to an electrophoresis display panel using a microcapsule as an electro-optical material, the microcapsule containing a colored liquid and white particles dispersed in the colored liquid. In addition, similarly to the above-described embodiments, the invention is also applicable to a twist ball display panel using a twist ball as an electro-optical material, the twist ball in which regions with different polarities are colored in different colors. Similarly to the above-described embodiments, the invention is also applicable to various electro-optical devices, such as a toner display panel using black toner as an electro-optical material or a plasma display panel using a high pressure gas, such as helium and neon, as an electro-optical material.

(4) In the embodiments described above, the precharge voltage and the data voltage outputted from the data line drive circuit 30 are supplied to the data lines 14 via the demultiplexer 57. However, the invention is not limited to this, and the data line drive circuit 30 may include output terminals as many as the number (4·J) of data lines 14, and the output terminals of the data line drive circuit 30 may be connected to the data lines 14 of the data line drive circuit 30 in a one-to-one correspondence. Furthermore, the data line drive circuit 30 may be formed in the electro-optical panel 100.

Examples of Application

Figure 13:
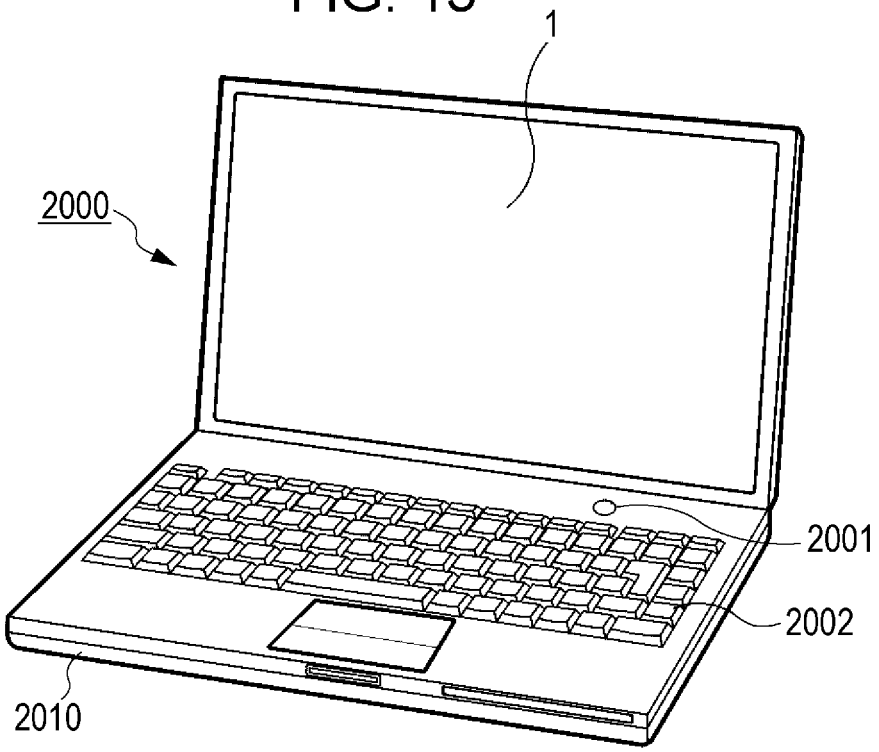
FIG. 13 is an explanatory diagram illustrating an example of electronic device.
Figure 14:
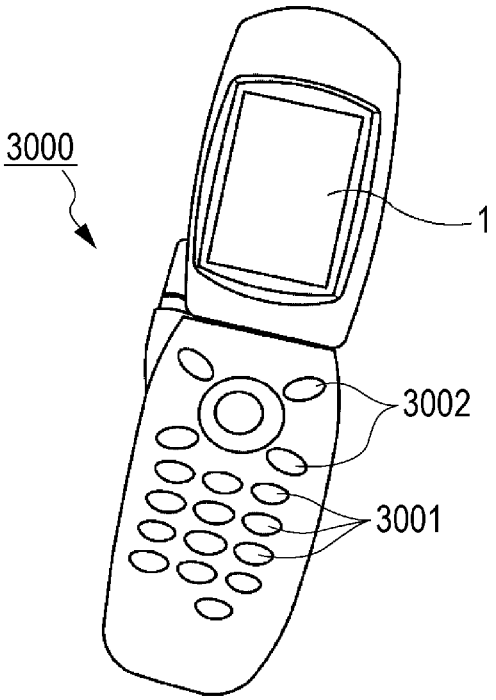
FIG. 14 is an explanatory diagram illustrating another example of electronic device.
Figure 15:
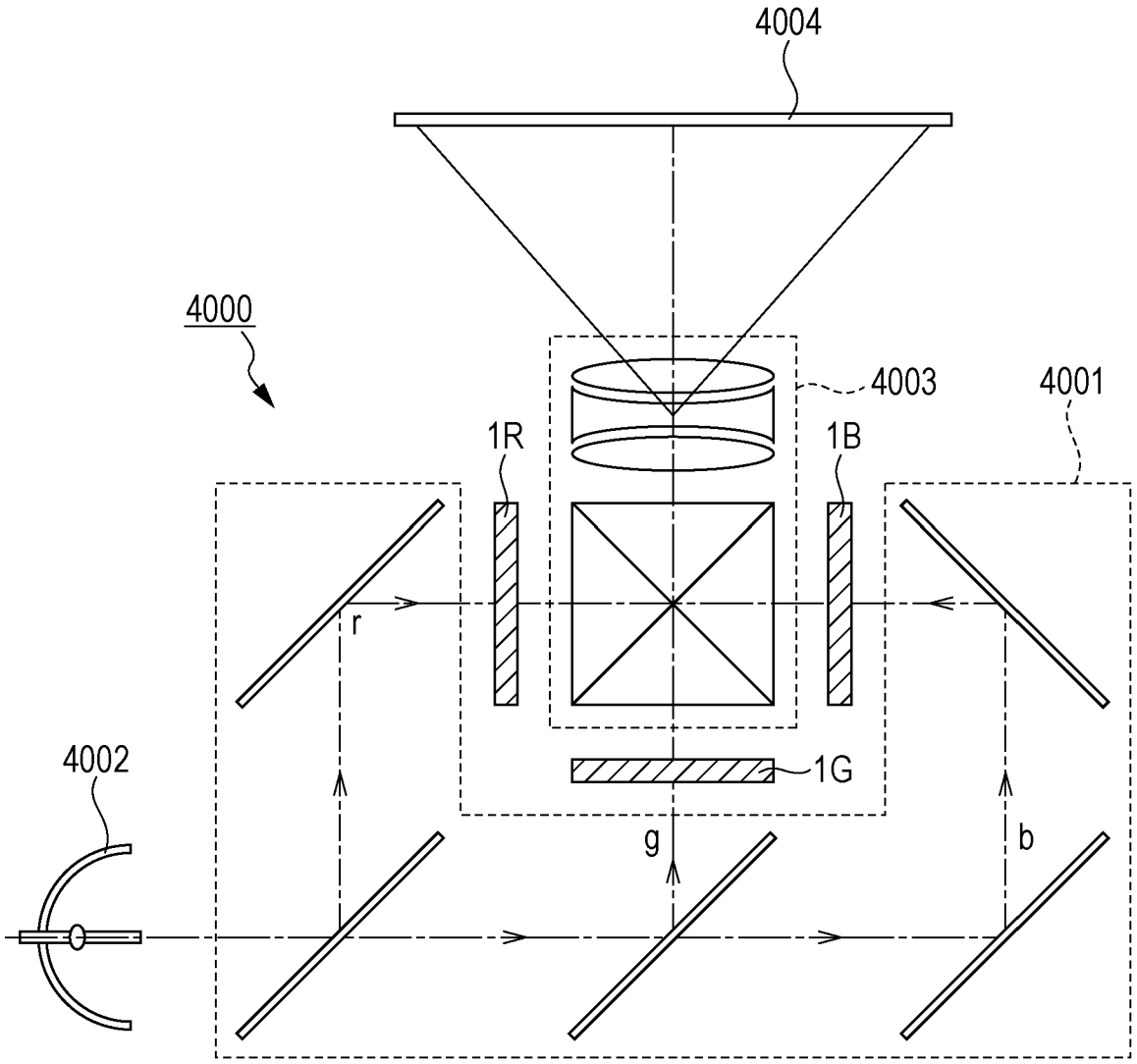
FIG. 15 is an explanatory diagram illustrating another example of electronic device.

The invention may be utilized for various electronic devices. FIGS. 13 to 15 each illustrate a specific form of electronic device to which the invention is applicable.

FIG. 13 is a perspective view of a portable personal computer that uses the electro-optical device. A personal computer 2000 includes an electro-optical device 1 that displays various images, and a main body 2010 in which a power switch 2001 and a keyboard 2002 are installed.

FIG. 14 is a perspective view of a mobile phone. A mobile phone 3000 includes multiple manual operation buttons 3001, scroll buttons 3002, and an electro-optical device 1 that displays various images. The screen displayed on the electro-optical device 1 is scrolled by operating the scroll buttons 3002. The invention is also applicable to such a mobile phone.

FIG. 15 is a schematic diagram illustrating the configuration of a projection display device (three-plate projector) 4000 using the electro-optical device. The projection display device 4000 includes three electro-optical devices 1 (1R, 1G, 1B) corresponding to different display colors R, G, B, respectively. An illumination optical system 4001 supplies a red component r in emission light from an illumination device (light source) 4002 to an electro-optical device 1R, supplies a green component g in the emission light to an electro-optical device 1G, and supplies a blue component b in the emission light to an electro-optical device 1B. The electro-optical devices 1 (1R, 1G, 1B) each function as an optical modulator (light valve) that modulates each monochromatic light supplied from the illumination optical system 4001, according to a display image. A projection optical system 4003 combines emission light from the electro-optical devices 1, and projects the combined light to a projection surface 4004. The invention is also applicable also to such a liquid crystal projector.

It is to be noted that the electronic device to which the invention is applicable includes mobile information terminal (personal digital assistants: PDA) in addition to the device illustrated in FIGS. 1, and 13 to 15. In addition, the electronic device includes a digital still camera, a television, a video camera, a car navigation device, an in-vehicle indicator (instrument panel), an electronic notebook, electronic paper, a calculator, a word processor, a workstation, a TV phone, and a POS terminal. Furthermore, the electronic device includes a printer, a scanner, a copying machine, a video player, and a device including a touch panel.

What is claimed is:

1. An electro-optical device comprising:

a plurality of scanning lines;

a plurality of data lines;

pixels each of which is provided for a corresponding one of intersections between the plurality of scanning lines and the plurality of data lines, and includes a pixel transistor that receives a voltage of corresponding one of the plurality of data lines;

a scanning line driver that outputs a scanning signal to each of the plurality of scanning lines based on a start pulse and a clock signal;

a data line driver that outputs a precharge voltage, then outputs a data voltage having a magnitude according to gradation to be displayed, and reverses a polarity of the data voltage with a predetermined period using a predetermined voltage as a reference;

a selector that outputs the precharge voltage and the data voltage, which are outputted by the data line driver, to a predetermined data line based on a selection signal that specifies start timing of output of the precharge voltage to the data line; and a controller that outputs the start pulse and the clock signal to the scanning line driver, outputs the selection signal to the selector, and changes an elapsed time, according to the polarity of the data voltage, from timing of transition of the clock signal from one of levels to the other of the levels until the start timing specified by the selection signal.

2. The electro-optical device according to claim 1, wherein timing of start of output of the precharge voltage by the data line driver is earlier than the start timing specified by the selection signal.

3. The electro-optical device according to claim 1, wherein a period in which the data line driver outputs the precharge voltage is approximately equal to a period in which the selection signal becomes active in order to output the prechage voltage to the predetermined data line.

4. The electro-optical device according to claim 1, wherein the precharge voltage when the data voltage has a positive polarity is higher than the precharge voltage when the data voltage has a negative polarity.

5. The electro-optical device according to claim 1, wherein the controller makes the elapsed time when the data voltage has a negative polarity longer than the elapsed time when the data voltage has a positive polarity.

6. The electro-optical device according to claim 1, wherein the pixels each include a retention capacitor in which one of terminals is connected to the pixel transistor, and the other of the terminals is connected to a capacitive line, and a period in which the precharge voltage is outputted to the plurality of data lines when the data voltage has a negative polarity is made shorter than a period in which the precharge voltage is outputted to the plurality of data lines when the data voltage has a positive polarity.

7. An electronic device including the electro-optical device according to claim 1.

* * * * *